US011613400B1

(12) United States Patent
Hogan

(10) Patent No.: US 11,613,400 B1
(45) Date of Patent: Mar. 28, 2023

(54) CONTAINER WITH INTERLOCKING SIDEWALLS

(71) Applicant: Packaging Corporation of America, Lake Forest, IL (US)

(72) Inventor: Andrew John Hogan, Comstock Park, MI (US)

( * ) Notice: Subject to any disclaimer, the term of this patent is extended or adjusted under 35 U.S.C. 154(b) by 0 days.

(21) Appl. No.: 17/128,780

(22) Filed: Dec. 21, 2020

Related U.S. Application Data

(60) Provisional application No. 62/953,797, filed on Dec. 26, 2019.

(51) Int. Cl.

| | |
|---|---|
| ***B65D 5/20*** | (2006.01) |
| ***B65D 5/54*** | (2006.01) |
| ***B65D 5/50*** | (2006.01) |
| ***B65D 5/22*** | (2006.01) |
| ***B31B 50/26*** | (2017.01) |
| ***B31B 50/00*** | (2017.01) |
| ***B31B 50/02*** | (2017.01) |
| ***B31B 50/25*** | (2017.01) |
| ***B31B 50/14*** | (2017.01) |

(52) U.S. Cl.
CPC ..... *B65D 5/2057* (2013.01); *B31B 50/002* (2017.08); *B31B 50/004* (2017.08); *B31B 50/02* (2017.08); *B31B 50/14* (2017.08); *B31B 50/25* (2017.08); *B31B 50/262* (2017.08); *B65D 5/22* (2013.01); *B65D 5/5021* (2013.01); *B65D 5/546* (2013.01)

(58) Field of Classification Search
CPC ..... B65D 5/2057; B65D 5/22; B65D 5/5021; B65D 5/546; B65D 5/667; B65D 2585/366; B65D 5/0085; B65D 5/30
USPC ..... 229/208, 146, 143, 149, 147, 178, 151, 229/148, 153, 152, 185; 206/749
See application file for complete search history.

(56) References Cited

U.S. PATENT DOCUMENTS 2,619,276 A * 11/1952 Gibbons ..... B65D 5/6679 229/149
2,852,177 A * 9/1958 Frasch ..... B65D 5/28 229/120.32
3,112,058 A * 11/1963 Martin ..... B65D 5/22 229/122
3,968,922 A 7/1976 Ruud
(Continued)

OTHER PUBLICATIONS

American Box Company, "Box Styles and Flutes," retrieved from https://amboxkc.com/box-styles-flutes/ on or before Oct. 31, 2019, 5 pages.

*Primary Examiner* — Christopher R Demeree
(74) *Attorney, Agent, or Firm* — Klarquist Sparkman, LLP

(57) ABSTRACT

A container includes a first portion, a second portion, and a locking panel. The first and second portion are pivotably coupled together. The first portion includes first sidewalls and the second portion includes second sidewalls. The first sidewalls of the first portion and the second sidewalls of the second portion abut when the container is in a closed configuration. The first and second sidewalls include interlocking tabs and slots that mate with each other when the container is in the closed configuration. The locking panel extends from the first portion and engages the second portion when the container is in the closed configuration, and the locking panel is configured to retain the container in the closed configuration.

20 Claims, 21 Drawing Sheets

(56) References Cited

U.S. PATENT DOCUMENTS

| | | | | | |
|---|---|---|---|---|---|
| 4,232,816 | A | * | 11/1980 | Johnson | B65D 5/667 229/149 |
| 4,265,393 | A | | 5/1981 | Orchard | |
| 4,266,713 | A | * | 5/1981 | Maroszek | B65D 5/6626 229/164 |
| 4,421,229 | A | * | 12/1983 | Pan | B65D 5/5445 229/120.32 |
| 4,955,527 | A | * | 9/1990 | Blackman | B65D 5/667 229/114 |
| 5,139,195 | A | | 8/1992 | McClure | |
| 5,445,314 | A | * | 8/1995 | Newsome | B65D 5/667 229/165 |
| 5,549,241 | A | | 8/1996 | Correll | |
| 5,772,110 | A | * | 6/1998 | Garretson | B65D 5/009 229/120.08 |
| 5,934,549 | A | * | 8/1999 | Baumgartner | B65D 5/422 229/92.8 |
| 6,283,364 | B1 | | 9/2001 | Gray, Sr. | |
| 7,533,774 | B2 | | 5/2009 | Zimmerman | |
| D652,717 | S | * | 1/2012 | Shimoyama | B65D 5/18 D9/432 |
| 8,459,536 | B2 | | 6/2013 | Hanna | |
| 8,523,049 | B2 | | 9/2013 | Fitzwater | |
| 8,579,778 | B2 | | 11/2013 | Aganovic et al. | |
| 8,770,466 | B1 | * | 7/2014 | Terlesky | B65D 5/48018 229/125 |
| 9,180,997 | B2 | * | 11/2015 | Melistas | B65D 5/5016 |
| 10,414,539 | B2 | | 9/2019 | Dorminey et al. | |
| 2008/0265011 | A1 | | 10/2008 | Specker | |

* cited by examiner

CONTAINER WITH INTERLOCKING SIDEWALLS

CROSS-REFERENCE TO RELATED APPLICATION

This application claims priority to U.S. Provisional Application No. 62/953,797, filed on Dec. 26, 2019, which is incorporated by reference herein.

FIELD

This disclosure relates generally to containers, including containers for use as delivery packages and methods of manufacturing such containers.

BACKGROUND

A container has an interior chamber for holding objects. The container can be closed to seal the objects within the interior chamber and opened to expose the objects. Once opened, the objects can be displayed in the container and/or removed from the container.

Some containers have a flap that can be opened to access the interior chamber or closed to seal the interior chamber. In some instances, opening the flap does not provide good access and/or visibility to objects within the interior chamber. These boxes can, for example, make it difficult to access the objects within the box and/or result in an unpleasant unboxing experience.

Other containers have two portions that separate from or pivot relative to each other to access the interior chamber. These containers have portions that overlap when the container is in a closed configuration to retain the objects within the container. Although such containers may provide improved access and/or unboxing, they use excessive amounts of raw materials.

As such, there is a continuing need for improved containers.

SUMMARY

Disclosed herein are examples of containers that can secure objects within the interior chamber, as well as provide easy access to the objects upon opening the container. The disclosed containers also provide a pleasant unboxing experience and/or reduce the consumption of materials.

The disclosed containers have a top portion and a bottom portion that are pivotably coupled together. The disclosed containers can be opened and closed by pivoting the top and bottom portions relative to each other. In this manner, the disclosed containers can be referred to as "clamshell containers." Clamshell containers can provide easy access to the objects disclosed therein and/or provide a pleasant unboxing experience. Unlike typical clamshell containers, however, the top and bottom portions of the disclosed containers do not overlap or nest within each other when the container is in the closed configuration. Accordingly, the disclosed containers do not use as much material as typical clamshell containers.

The disclosed containers can also include mating features (e.g., interlocking sidewalls, flaps, etc.) configured to retain the top and bottom portions of the containers in the closed configuration. In some embodiments, additional locking and/or unlocking features can be provided. Additionally or alternatively, the disclosed containers can comprise product retention features configured to retain and/or secure objects within the containers.

In one representative embodiment, a container includes a first portion, a second portion, and a locking panel. The first and second portion are pivotably coupled together. The first portion includes first sidewalls and the second portion includes second sidewalls. The first sidewalls of the first portion and the second sidewalls of the second portion abut when the container is in a closed configuration. The first and second sidewalls include interlocking tabs and slots that mate with each other when the container is in the closed configuration. The locking panel extends from the first portion and engages the second portion when the container is in the closed configuration, and the locking panel is configured to retain the container in the closed configuration.

In some embodiments, the first portion of the container includes first tabs and first slots, and the second portion of the container includes second tabs and second slots. The first tabs of the first portion mate with the second slots of the second portion when the container is in the closed configuration, and the second tabs of the second portion mate with the first slots of the first portion when the container is in the closed configuration.

In some embodiments, the container is formed from a single-piece blank.

In some embodiments, the first portion is a top portion, and the second portion is a bottom portion.

In some embodiments, the container further includes a sealing member coupled to the locking panel. The locking panel can be secured to the second portion to retain the container in the closed configuration. The sealing member can be removed from the locking panel, thereby allowing the container to move from the closed configuration to an open configuration.

In some embodiments, the sealing member includes a tear strip defined by a plurality of perforations.

In some embodiments, the sealing member includes a cable or a string.

In some embodiments, the first portion includes a top panel, a first front panel, a first back panel, the first sidewalls, and the locking panel, and the second portion includes a bottom panel, a second front panel, a second back panel, and the second sidewalls.

In some embodiments, the first sidewalls include an inner member, an outer member, and a plurality of intermediate members, and the intermediate members are disposed between the inner member and the outer member when the container is in an assembled configuration.

In some embodiments, the container further includes one or more product retention panels disposed in an interior chamber of the container and configured for engaging an exterior surface of an object disposed within the interior chamber of the container.

In some embodiments, the one or more product retention panels comprises an opening configured for receiving the object.

In some embodiments, the container comprises cardboard and/or corrugated cardboard.

In another representative embodiment, a box includes a first portion and a second portion. The first portion includes a top panel, a first front panel, a first back panel, a plurality of first sidewalls, and a locking panel. The top panel, the first front panel, the first back panel, and the first sidewalls define a first interior chamber configured for receiving a first segment of an object. The second portion includes a bottom panel, a second front panel, a second back panel, and a plurality of second sidewalls. The bottom panel, the second front panel, the second back panel, and the second sidewalls define a second interior chamber configured for receiving a second segment of the object. The first back panel of the first portion and the second back panel of the second portion are pivotably coupled together such that the first portion and the second portion can pivot relative to each other between a closed configuration and an open configuration. In the closed configuration, the first sidewalls of the first portion abut the second sidewalls of the second portion, and the first sidewalls and the second sidewall include mating features that contact. In the open configuration, the first sidewalls, the second sidewalls, and the mating features are spaced apart.

In some embodiments, the mating features include tabs and slots.

In some embodiments, the box further includes a plurality of product retention panels coupled to the first portion or the second portion.

In some embodiments, the product retention panels are coupled to the first portion and the second portion.

In some embodiments, one of the product retention panels includes an opening configured for receiving the object.

In some embodiments, each of the product retention panels includes an opening configured for receiving the object.

In some embodiments, two or more of the product retention panels collectively form an opening configured for receiving the object.

In some embodiments, the object is a bottle, the first segment of the object is a base of the bottle, and the second segment of the object is a neck of the bottle.

In some embodiments, the box includes cardboard and/or corrugated cardboard.

The various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosure will become more apparent from the following detailed description, claims, and accompanying figures.

DETAILED DESCRIPTION

General Considerations

Figure 1:
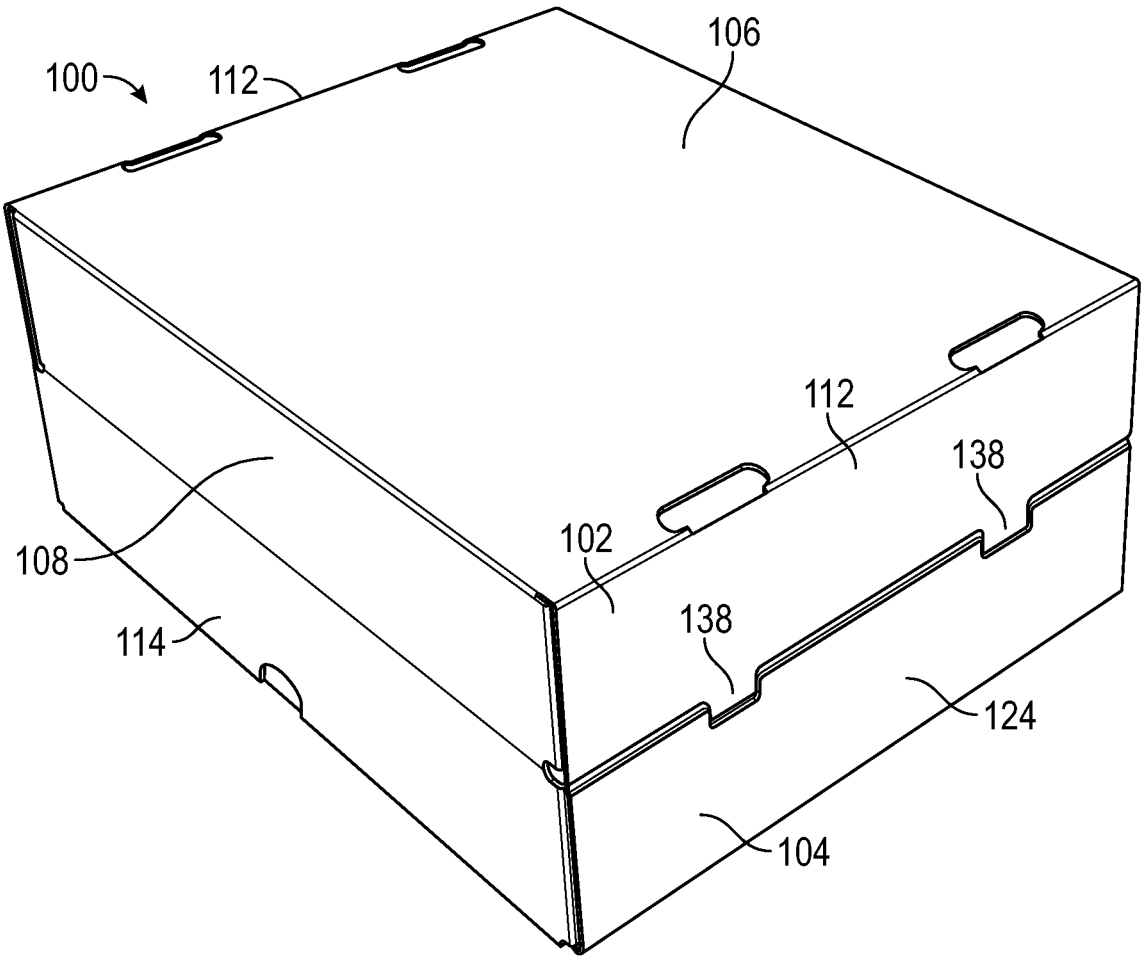
FIG. 1 is a perspective view of an exemplary container, showing the container assembled and in a closed and locked configuration.

As used in this application the singular forms "a," "an," and "the" include the plural forms unless the context clearly dictates otherwise. Additionally, the term "includes" means "comprises." Furthermore, as used herein, the term "and/or" means any one item or combination of items in the phrase. In addition, the term "exemplary" means serving as a non-limiting example, instance, or illustration. As used herein, the terms "e.g." and "for example" introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the terms "box" and "container" refer to an article that is capable of holding one or more products or other physical articles. As used herein, the term "cardboard box" refers to a box formed from any of a variety of heavy paper-like materials, including, for example, cardstock, corrugated fiberboard, and/or paperboard. As used herein, the term "corrugated fiberboard" refers to a fluted corrugated medium with one or more flat liner boards coupled thereto, such as a central corrugated layer with a first liner board on one side and a second liner board on another side of the central corrugated layer.

As used herein, the term "blank" refers to a flat sheet of material that is formed into a container, such as a flat sheet of corrugated paperboard. As used herein, the term "flat-formed" refers to an article that is manufactured from one or more flat pieces, such as a blank, that is manipulated into a different shape, such as by folding. As used herein, the terms "hingedly coupled" and/or "pivotably coupled" refers to any manner of engagement between a first part of a blank relative to a second part of the blank which allows the first part to travel relative to the second part without the first part becoming disengaged from the second part, such as by one or more fold lines, one or more cut lines, and/or some combination thereof. As used herein, the term "cut line" refers to an area that includes a cut that extends at least partially through the blank to facilitate folding, tearing, and/or some other structural advantage. Cut lines can be straight, curved, or some other shape, and can include perforation lines in which the cut is not continuous along the length of the cut line (i.e., a perforated line is a cut line that is discontinuous).

As used herein, the terms "graphic" and "graphical element" refer to any visual design elements including, but not limited to, photos, logos, text, illustrations, instructions, advertisements, lines, shapes, patterns, and/or images of various kinds, as well as any combinations of these elements. The terms graphic and graphical element are not intended to be limiting and can incorporate any number of contiguous or non-contiguous visual features. A graphic can be applied to a surface of a material, such as a blank, in any suitable manner. For example, a graphic can be provided on a surface by printing, lamination, adhesive application, coating application (e.g., paint), embossing, and/or any other means.

For the purposes of this disclosure, relative terms such as "vertical", "horizontal", "top", "bottom", "front", "back", "end" and "sides" may be used. It should be understood, however, that the terms are used only for purposes of description and are not intended to be used as limitations. Accordingly, the orientation of an object or a combination of objects may change without altering the scope of the claimed subject matter.

Introduction to the Disclosed Technology

As mentioned in the Background section above, some typical containers can make it difficult to access objects disposed within the container and/or provide an unpleasant unboxing experience. Other typical containers may provide better access to objects within the container and/or improve the unboxing experience, but these containers use excessive amounts of raw materials to produce.

Disclosed herein are examples of containers that can secure objects within the interior chamber, as well as provide easy access to the objects upon opening the container. The disclosed containers also provide a pleasant unboxing experience and/or reduce the consumption of materials.

The disclosed containers have a top portion and a bottom portion that are pivotably coupled together. The disclosed containers can be opened and closed by pivoting the top and bottom portions relative to each other. In this manner, the disclosed containers can be referred to as "clamshell containers." Clamshell containers can provide easy access to the objects disclosed therein and/or provide a pleasant unboxing experience. Unlike typical clamshell containers, however, the top and bottom portions of the disclosed containers do not overlap or nest within each other when the container is in the closed configuration. Accordingly, the disclosed containers do not use as much material as typical clamshell containers.

The disclosed containers can also include mating features (e.g., interlocking sidewalls, flaps, etc.) configured to retain the top and bottom portions of the containers in the closed configuration. In some embodiments, additional locking and/or unlocking features can be provided. Additionally or alternatively, the disclosed containers can comprise product retention features configured to retain and/or secure objects within the containers.

Further details and examples are provided below.

Exemplary Containers and Methods of Constructing

Figure 2:
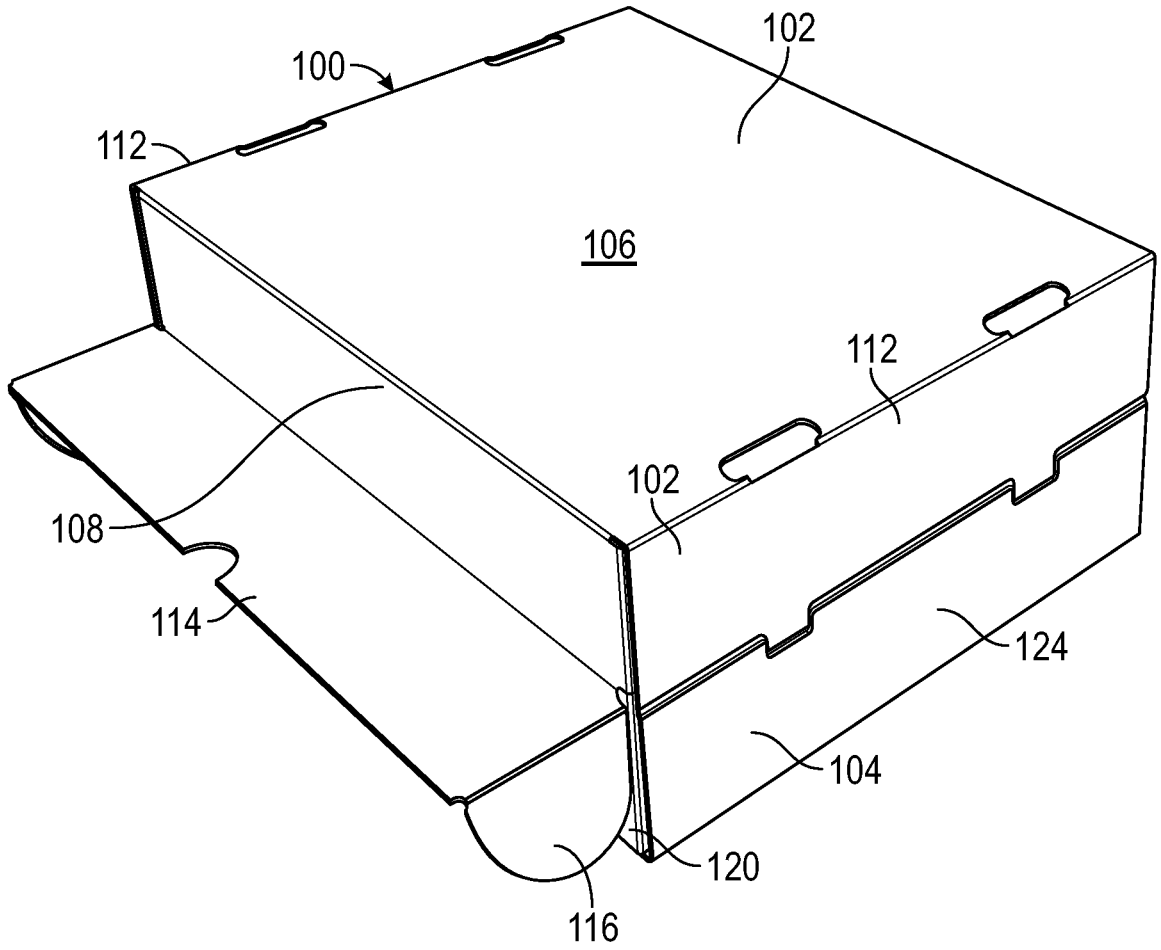
FIG. 2 is a perspective view of the container of FIG. 1, showing the container assembled and in a closed and unlocked configuration.
Figure 3:
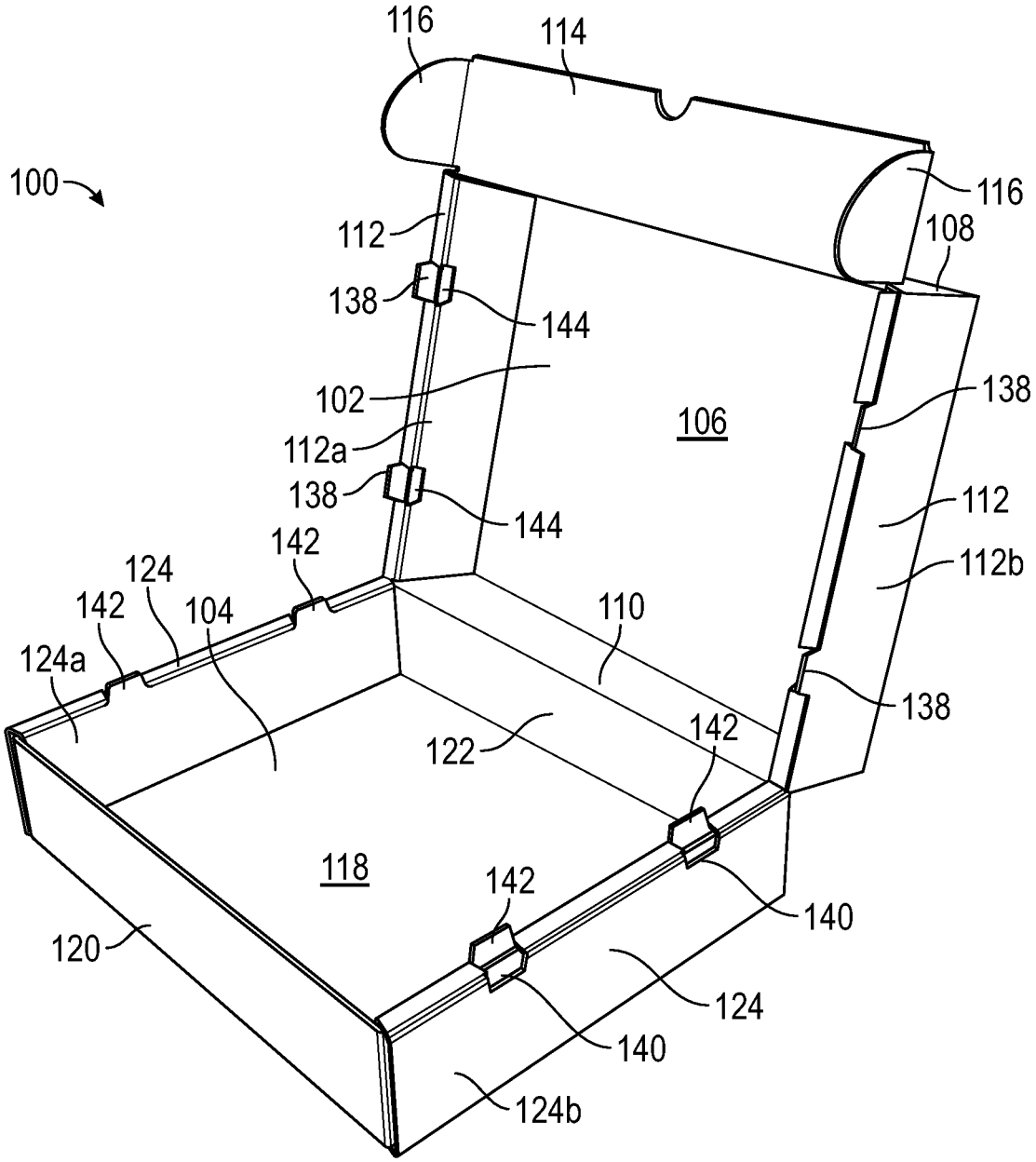
FIG. 3 is a perspective view of the container of FIG. 1, showing the container assembled and in an open configuration.
Figure 4:
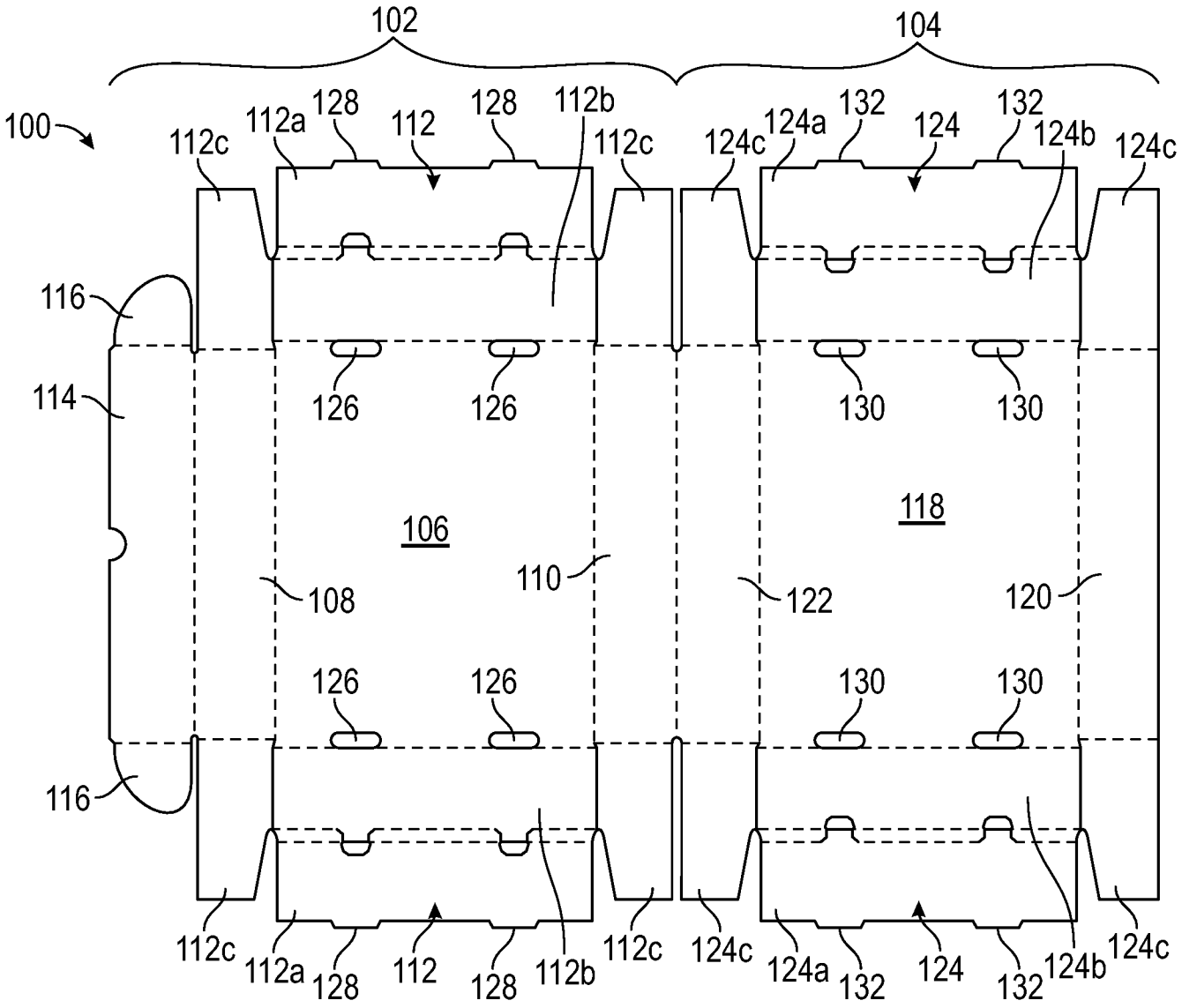
FIG. 4 is a plan view of the container of FIG. 1, showing the container in a "blank" or flat configuration.
Figure 9:
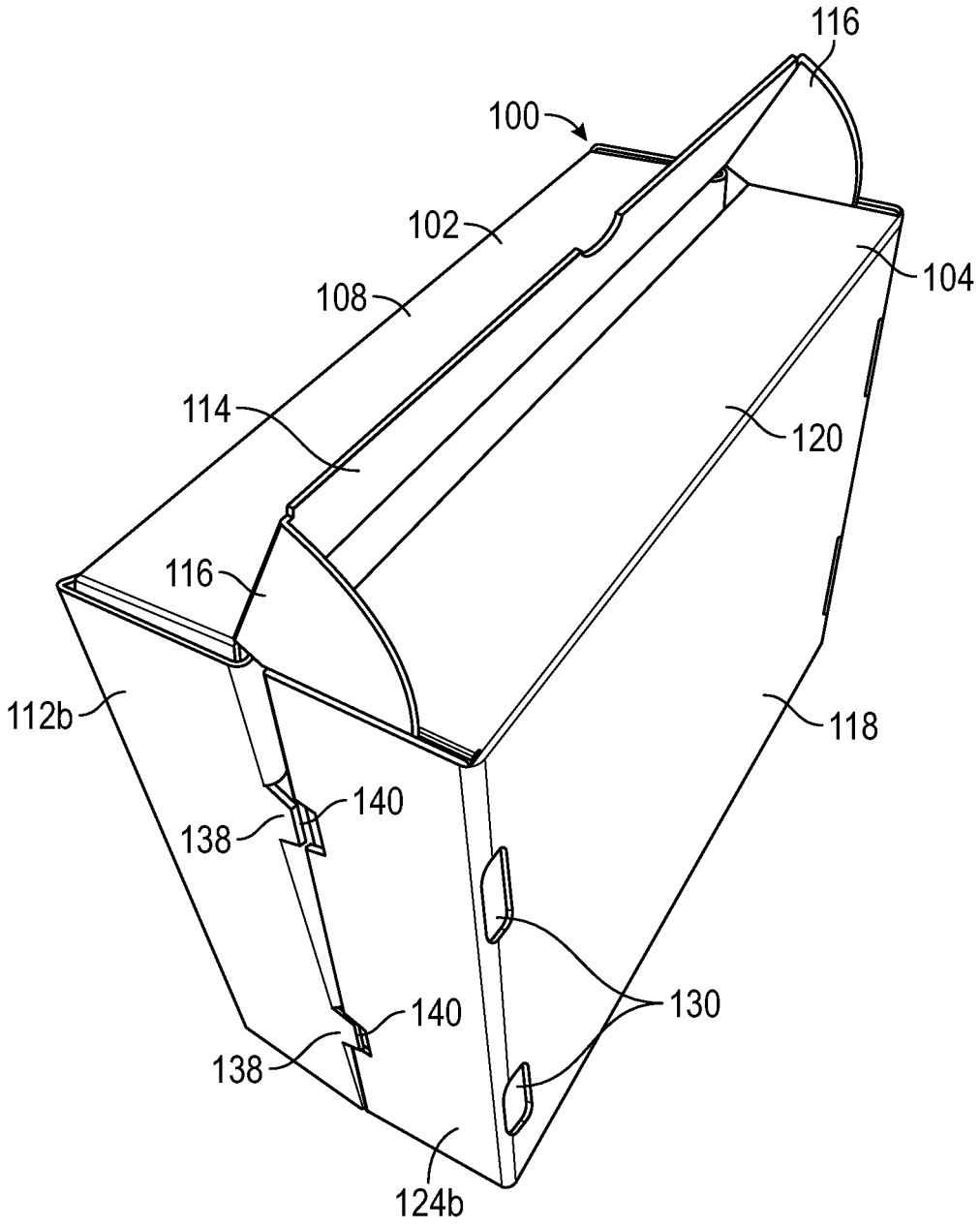
Figure 10:
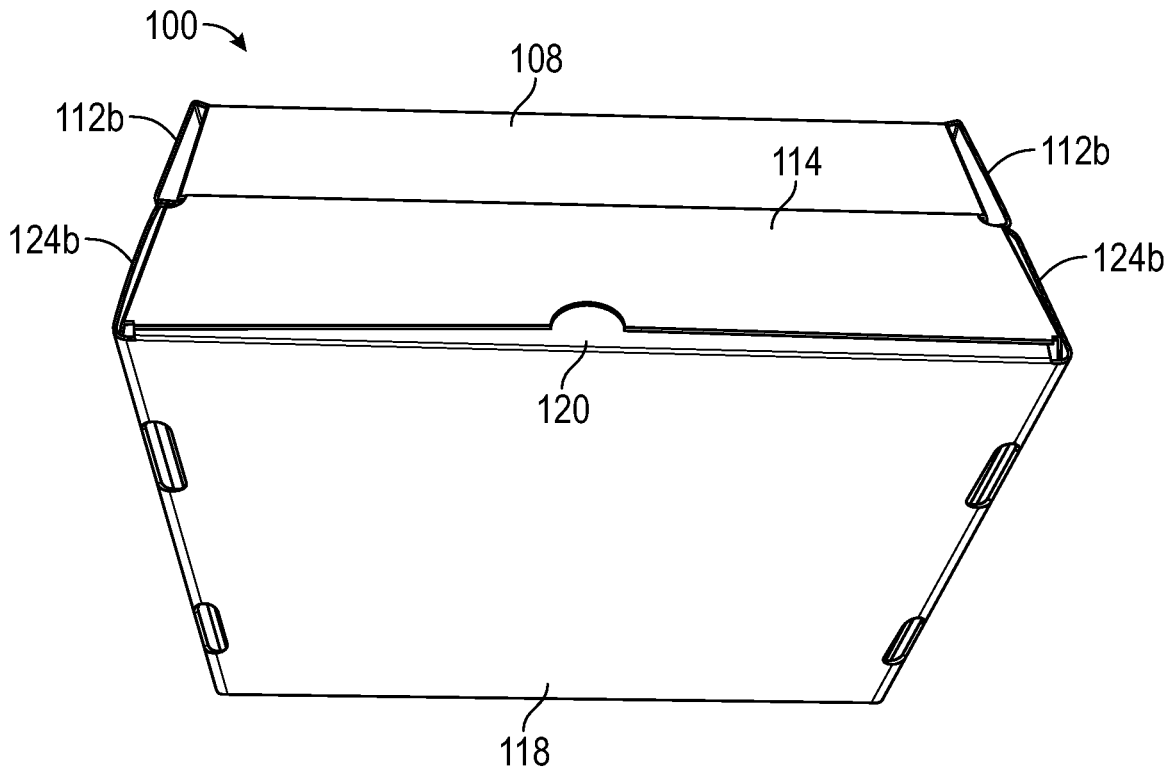
Figure 11:
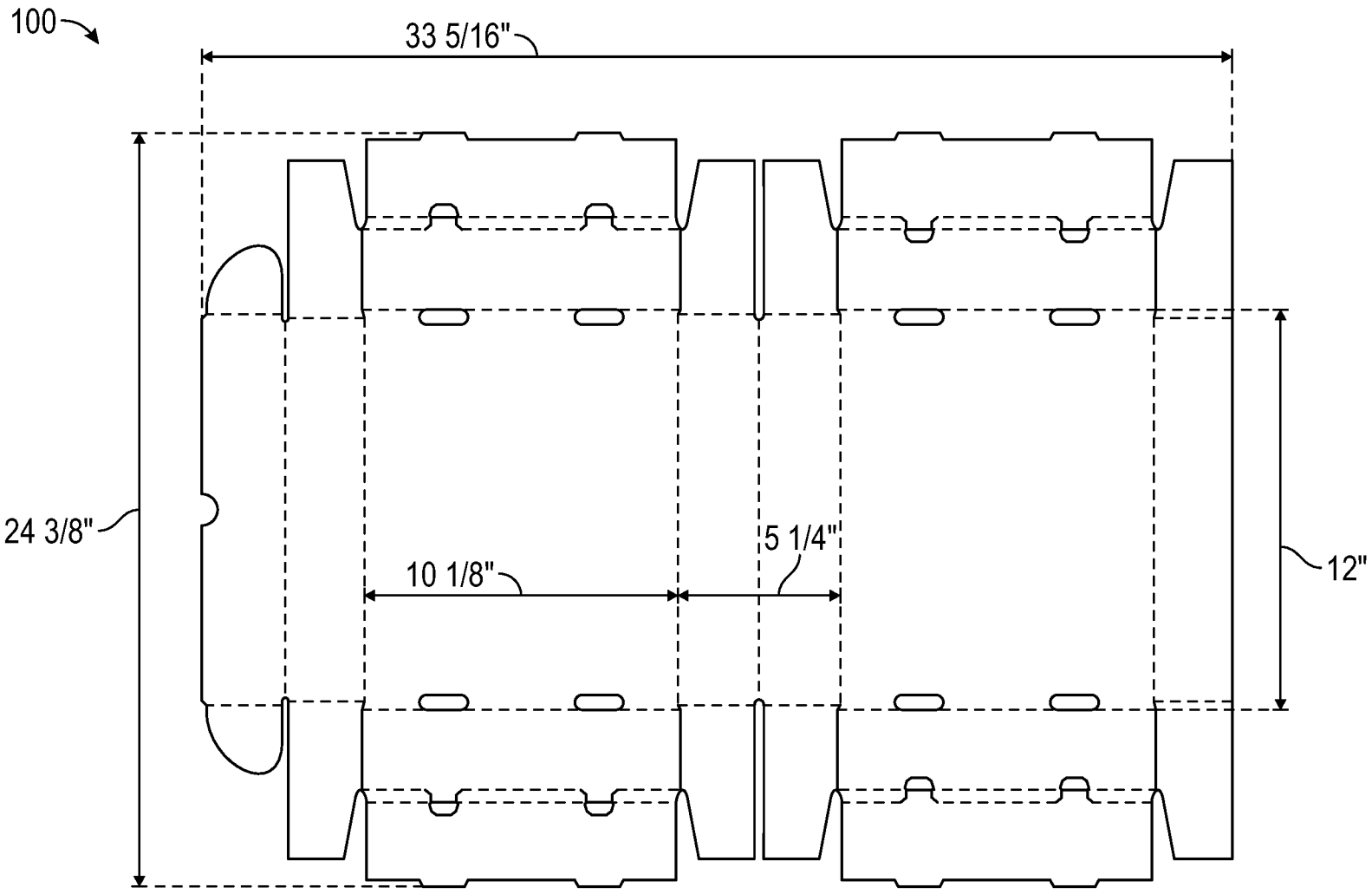
FIG. 11 is a plan view of the container of FIG. 1, showing the container in the blank configuration and with exemplary dimensions.

FIGS. 1-11 show a container 100, according to one embodiment. FIG. 1 shows the container 100 assembled and in a closed and locked configuration. FIG. 2 shows the container 100 assembled and in a closed and unlocked configuration. FIG. 3 shows the container 100 assembled and in an open configuration. FIG. 4 shows the container 100 in a "blank" or flat configuration. FIGS. 5-10 depict an exemplary method of assembling the container 100 from the blank configuration (FIG. 4) to the assembled, closed, and locked configuration (FIG. 1). FIG. 11 depicts exemplary dimensions of the container 100.

Referring to FIGS. 1-3, the container 100 comprises two main components: a top portion 102 and a bottom portion 104. The top portion 102 and the bottom portion 104 are pivotably coupled together such that the container 100 can be moved between a closed configuration (FIG. 1) and an open configuration (FIG. 3). In this manner, the container 100 can be referred to as "a clamshell container." Unlike typical clamshell containers, however, the components of the top portion 102 and the bottom portion 104 of the container abut rather than overlap when the container 100 is in the closed configuration (FIGS. 1-2). As such, the container 100 uses less raw material than typical clamshell containers.

Figure 6:
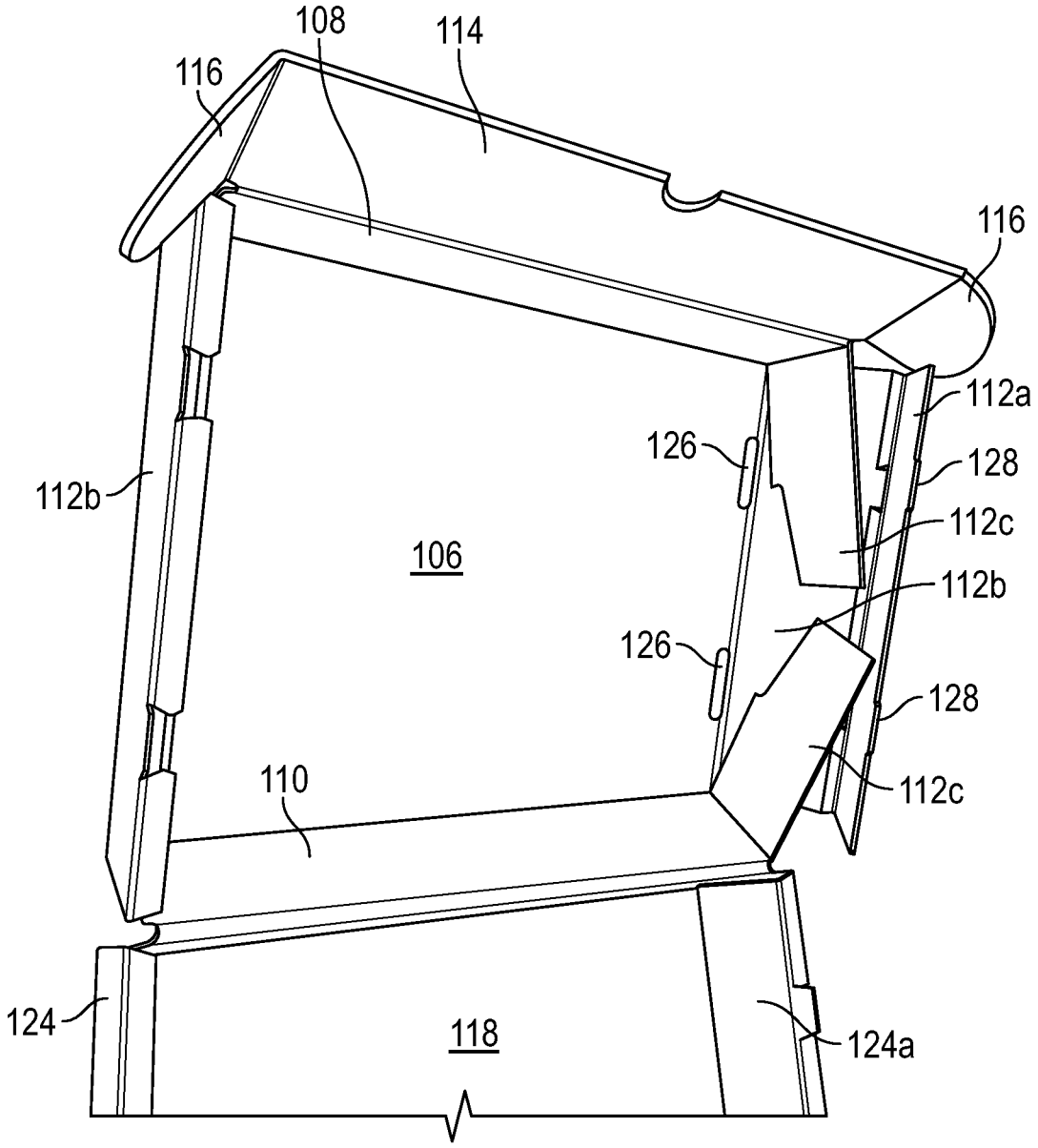

Referring to FIG. 3, the top portion 102 of the container 100 includes a top panel 106, a front panel 108, a back panel 110, sidewalls 112, and a locking panel 114. Referring now to FIG. 4, each sidewall 112 of the top portion 102 comprises an inner member 112*a*, an outer member 112*b*, and a plurality of intermediate members 112*c*. As shown in FIGS. 3 and 6, the intermediate members 112*c* can be disposed between the inner member 112*a* and the outer member 112*b* when the sidewalls 112 are assembled. As shown in FIGS. 1-2, the locking panel 114 extends from the front panel 108 and comprises a plurality of flaps 116 configured to selectively engage the bottom portion 104 to help retain the container 100 in the closed configuration.

Figure 7:
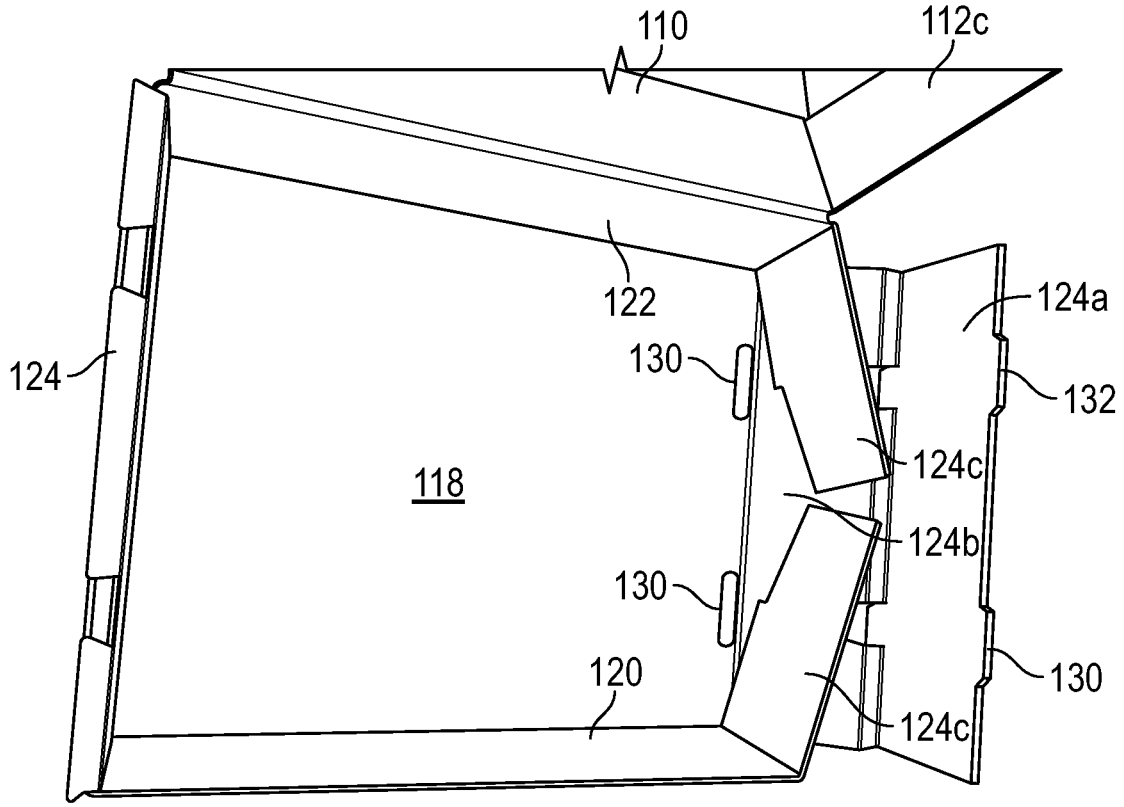

Referring again to FIG. 3, the bottom portion 104 of the container 100 includes a bottom panel 118, a front panel 120, a back panel 122, and sidewalls 124. Referring to FIG. 4, each sidewall 124 of the bottom portion 104 comprises an inner member 124*a*, an outer member 124*b*, and a plurality of intermediate members 124*c*. As shown in FIGS. 3 and 7, the intermediate members 124*c* can be disposed between the inner member 124*a* and the outer member 124*b* when the sidewalls 112 are assembled.

FIG. 4 shows the container 100 in a flat configuration. In the flat configuration, the container 100 can also be referred to as "the blank 100." The blank 100 can comprise a one-piece, unitary construction in which each of the panels, walls, extension portions, tabs, fold lines, etc., are integrally formed with the blank. As used herein, the terms "unitary construction" and "integrally formed" refer to a construction that does not include any welds, fasteners, or other means for securing separately formed pieces of material to each other. In other embodiments, any of the various panels, extension portions, tabs, etc., can be separately formed and secured to the main body of the box (e.g., with adhesive, fasteners, and/or other securing means).

The containers disclosed herein can be formed of various cardboard and/or paper products. The container configurations described herein can also be made from polymeric materials. In certain embodiments, each of the cuts, fold lines, score lines, etc., of the blank can be formed in an in-line, streamlined manufacturing process such that the blank can be produced without requiring that the production equipment be stopped.

The blank 100 shown in FIG. 4 has various fold lines (i.e., shown as "green" lines) and/or perforations (i.e., shown as "dashed" lines). The blank 100 can be folded along the fold lines to produce a three-dimensional container. The perforations can aid folding in certain directions and/or allow a portion of the container 100 to be removed (e.g., torn off without the use of a cutting tool).

Figure 5:
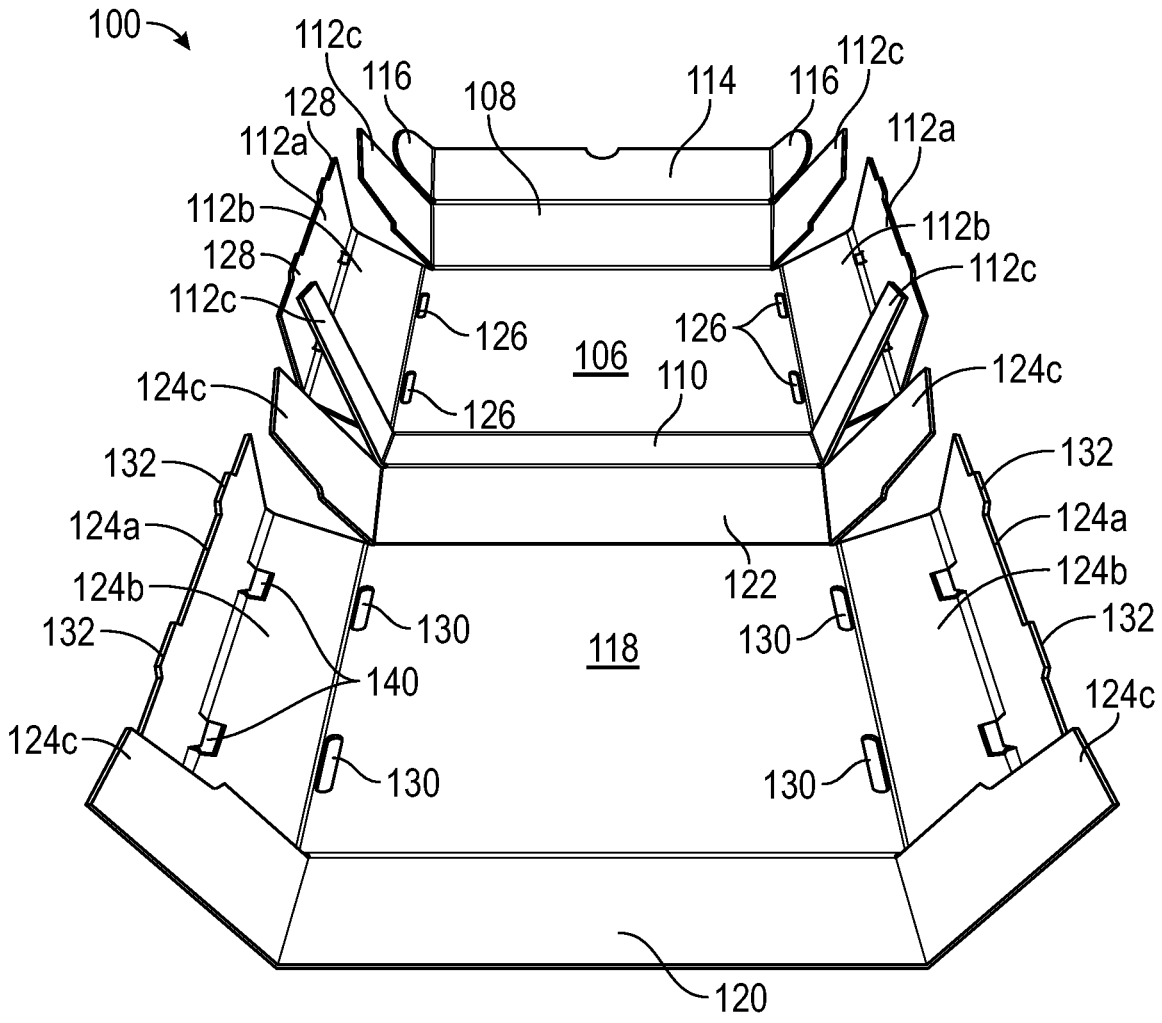
FIGS. 5-10 are various perspective views of the container of FIG. 1, depicting an exemplary method of assembling the container from the blank configuration of FIG. 4 to the assembled, closed, and locked configuration of FIG. 1.

FIGS. 5-10 depict an exemplary method of assembling the container from the blank configuration shown in FIG. 4 to the assembled, closed, and locked configuration shown in FIG. 1. In FIG. 5, the container 100 is essentially in the blank configuration, but some of the panels have been partially folded. As shown in FIG. 6, the top portion 102 of the container 100 can be assembled by folding the front panel 108 and the back panel 110 relative to the top panel 106 such that the front panel 108 and the back panel 110 are at least substantially perpendicular to the top panel 106. This brings the intermediate members 112*c* on each side of the sidewalls 112 toward each other, as illustrated by the intermediate members 112*c* on the righthand side of the container 100 as depicted in FIG. 6. As also shown in FIG. 6, the inner member 112*a* of each sidewall 112 can be moved over the intermediate members 112*c*. This positions the intermediate members 112*c* of each sidewall 112 laterally between the inner member 112*a* and the outer member 112*b*. Accordingly, the inner member 112*a* and the outer member 112*b* prevent the intermediate members 112*c* from moving away from each other, which in turn restricts the front panel 108 and the back panel 110 from moving relative to the inner member 112*a* and the outer member 112*b*.

As shown in FIG. 4, the top panel 106 comprises one or more openings 126 configured for receiving corresponding one or more projections 128 extending from the inner members 112*a*. Returning to FIG. 6, the projections 128 can mate with respective openings 126 when the inner members 112*a* are folded over the intermediate members 112*c*. The mated engagement can help to retain the sidewalls 112 in an at least substantially perpendicular orientation relative to the top panel 106 and relative to the front panel 108 and back panel 110. In other embodiments, the openings 126 and/or projections 128 can be omitted, and the sidewalls 112 can be secured in various other ways such as by frictional engagement, adhesive, fasteners, and/or other means for securing.

As shown in FIG. 7, the bottom portion 104 of the container 100 can be assembled by folding the front panel 120 and the back panel 122 relative to the bottom panel 118 such that the front panel 120 and the back panel 122 are at least substantially perpendicular to the bottom panel 118. This brings the intermediate members 124*c* on each side of the sidewalls 124 toward each other, as illustrated by the intermediate members 124*c* on the righthand side of the container 100 as depicted in FIG. 7. As also shown in FIG. 7, the inner member 124*a* of each sidewall 124 can be moved over the intermediate members 124*c*. This positions the intermediate members 124*c* of each sidewall 124 laterally between the inner member 124*a* and the outer member 124*b*. In this manner, the inner member 124*a* and the outer member 124*b* prevent the intermediate members 124*c* from moving away from each other, which in turn restricts the front panel 120 and the back panel 122 from moving relative to the inner member 124*a* and the outer member 124*b*.

As shown in FIG. 4, the bottom panel 118 comprises one or more openings 130 configured for receiving corresponding one or more projections 132 extending from the inner members 124*a*. Returning to FIG. 7, the projections 132 can mate with respective openings 130 when the inner members 124*a* are folded over the intermediate members 124*c*. The mated engagement can help to retain the sidewalls 124 in an at least substantially perpendicular orientation relative to the bottom panel 118 and relative to the front panel 120 and back panel 122. In other embodiments, the openings 130 and/or projections 132 can be omitted, and the sidewalls 124 can be secured in various other ways such as by frictional engagement, adhesive, fasteners, and/or other means for securing.

Figure 8:
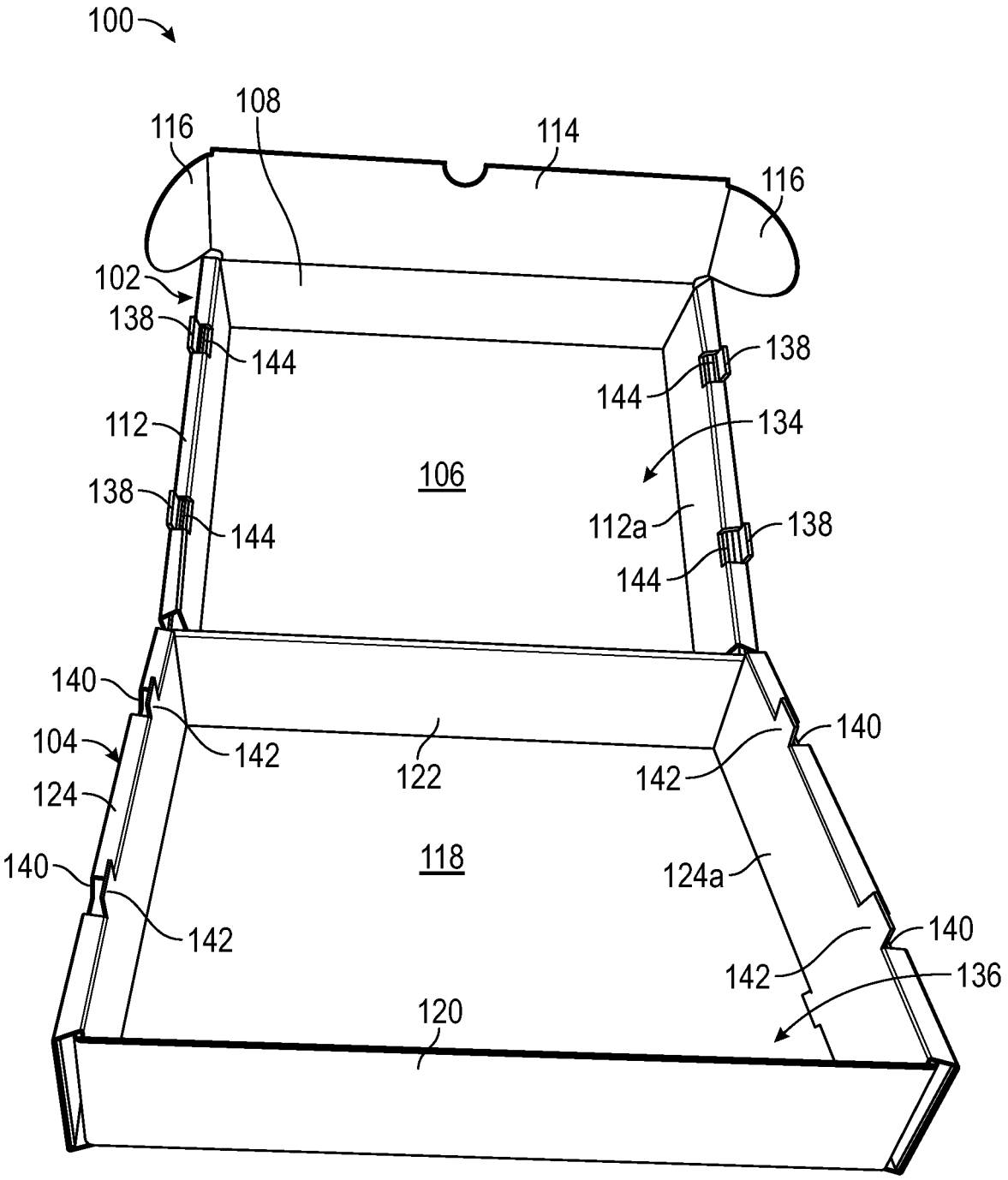

FIG. 8 shows the container 100 in an assembled, open configuration. The top portion 102 comprises an interior chamber 134 defined by the top panel 106, the front panel 108, the back panel 110, and the sidewalls 112. Similarly, the bottom portion 104 comprises an interior chamber 136 defined by the bottom panel 118, the front panel 120, the back panel 122, and the sidewalls 124.

Referring still to FIG. 8, the sidewalls 112 of the top portion 102 can comprise one or more mating features configured to engage one or more corresponding mating features of the sidewalls 124 of the bottom portion 104. For example, as shown, the sidewalls 112 of the top portion 102 comprise a plurality of tabs 138, and the sidewalls 124 of the bottom portion 104 comprise a plurality of slots 140 configured for receiving the tabs 138 of the top portion 102. The sidewalls 124 of the bottom portion 104 also comprise a plurality of tabs 142, and the sidewalls 112 of the top portion 102 comprise a plurality of slots 144 configured for receiving the tabs 142 of the bottom portion 104. See also FIG. 3. As shown in FIG. 9, the tabs and slots of the top and bottom portion can mate with each other. In this manner, the tabs and slots can, for example, help retain the container 100 in a closed configuration when the sidewalls 112, 124 abut. The tabs and slots can also help resist relative lateral (e.g., side-to-side) movement between the top and bottom portions of the container.

The tabs and slots of the container 100 can be formed by scoring the sidewalls 112, 124, as shown in FIG. 4. As shown in FIGS. 3-4, the tabs 138 of the top portion 102 and the slots 140 of the bottom portion 104 are disposed on the outwardly facing sides of the sidewalls 112, 124, respectively, and the tabs 142 of the bottom portion 104 and the slots 144 of the top portion 102 are disposed on the inwardly facing sides of the sidewalls 112, 124. In other embodiments, the tabs 142 of the bottom portion 104 and the slots 144 of the top portion 102 can be disposed on the outwardly facing sides of the sidewalls 112, 124, respectively, and the tabs 138 of the top portion 102 and the slots 140 of the bottom portion 104 can be disposed on the inwardly facing sides of the sidewalls 112, 124.

The tabs and slots can comprise various shapes. For example, as shown, the tabs 138, 142 and slots 140, 144 comprise a trapezoidal shape. In other embodiments, the tabs and slots can comprise various other shapes, such as square, rectangular, triangular, circular, ovular, etc.

When the container 100 is closed, the locking panel 114 can be used to secure the top portion 102 relative to the bottom portion 104. This can be accomplished by inserting the flaps 116 of the locking panel 114 into a space laterally between the front panel 120 and the outer members 124*b*, as shown in FIGS. 9-10. In this manner, the locking panel 114 can prevent the top portion 102 and the bottom portion 104 from pivoting relative to each other along the fold line separating the back panel 110 of the top portion 102 and the back panel 122 of the bottom portion 104.

As shown in FIGS. 1, 2, 9, and 10, when the container 100 is closed, the front panels 108, 120 abut, and the sidewalls 112, 124 abut. The surfaces of the top and bottom portions that contact each other in this manner when the container is in the closed configuration can thus be referred to as "abutting surfaces" and/or "abutment surfaces." By forming the container 100 with abutting surfaces rather than overlapping/nesting panels like typical clamshell containers, the container 100 reduces the amount of raw material that is used to form a container.

Figure 12:
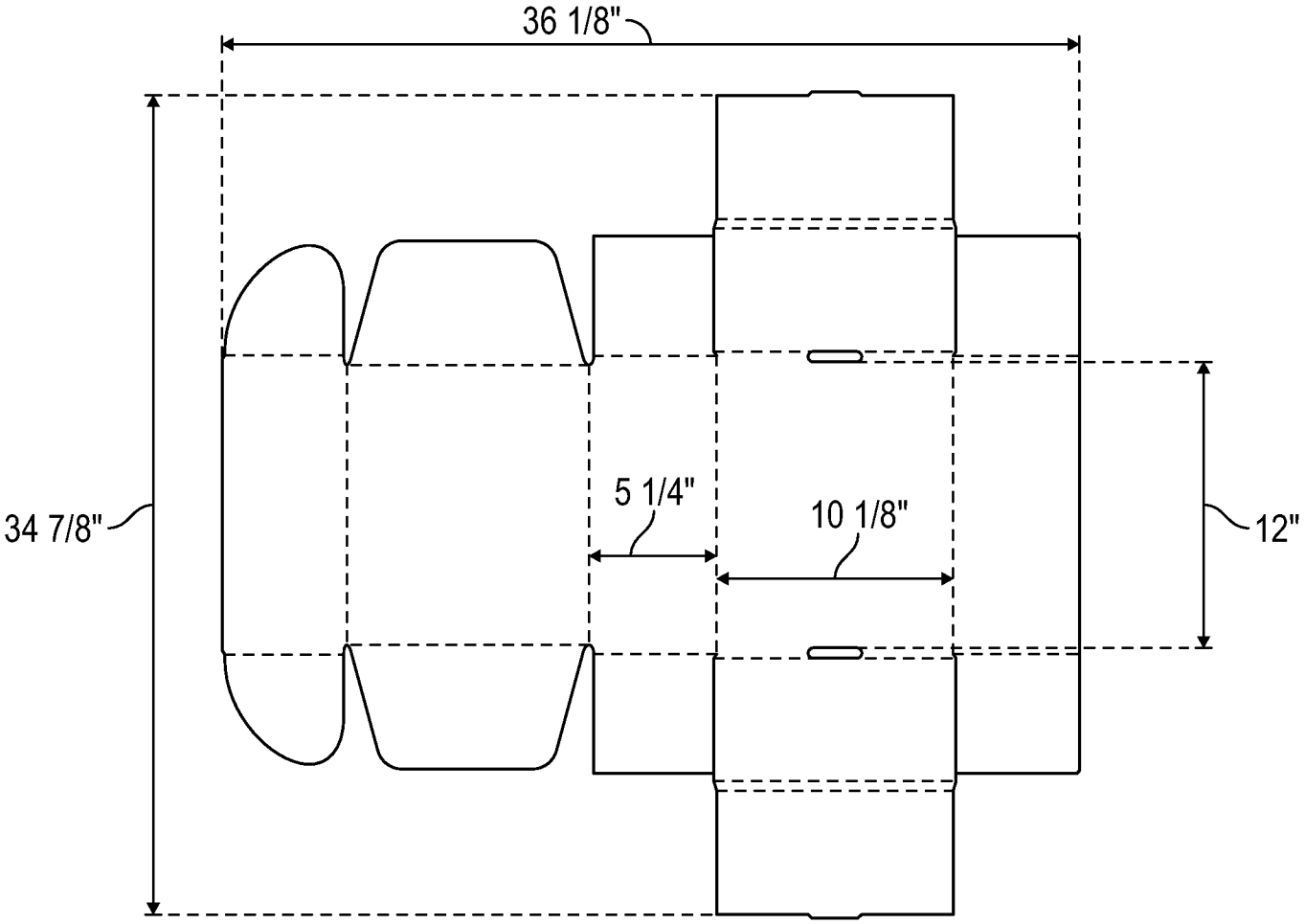
FIG. 12 (Prior Art)
FIG. 12 is a plan view of a prior art container, showing the container in the blank configuration and with exemplary dimensions.

As one example, when configuring the container 100 with a 12 in.×10-⅛ in.×5-¼ in. interior chamber (i.e., the dimensions of the interior chambers 134, 136 combined), the dimensions of the blank of the container 100 are 24-⅜ in.×33-5/16 in., as shown in FIG. 11. In this example, the container 100 uses approximately 812 in.$^2$ of material. As shown in FIG. 12, a typical clamshell container with a 12 in.×10-⅛ in.×5-¼ in. interior chamber would have a blank that is 34-⅞ in.×36-⅛ in., as shown in FIG. 12. The typical clamshell container of FIG. 12 would use about 1260 in.$^2$. Thus, the container 100 configured as shown in FIG. 11 uses about 36 percent less material that the typical clamshell container of FIG. 12. When the depth dimension (i.e., the 5-¼ in.) is increased relative to the other dimension (i.e., width and/or length), the material-saving advantage of the disclosed clamshell containers over typical clamshell containers is even greater (e.g., >36 percent).

Figure 13:
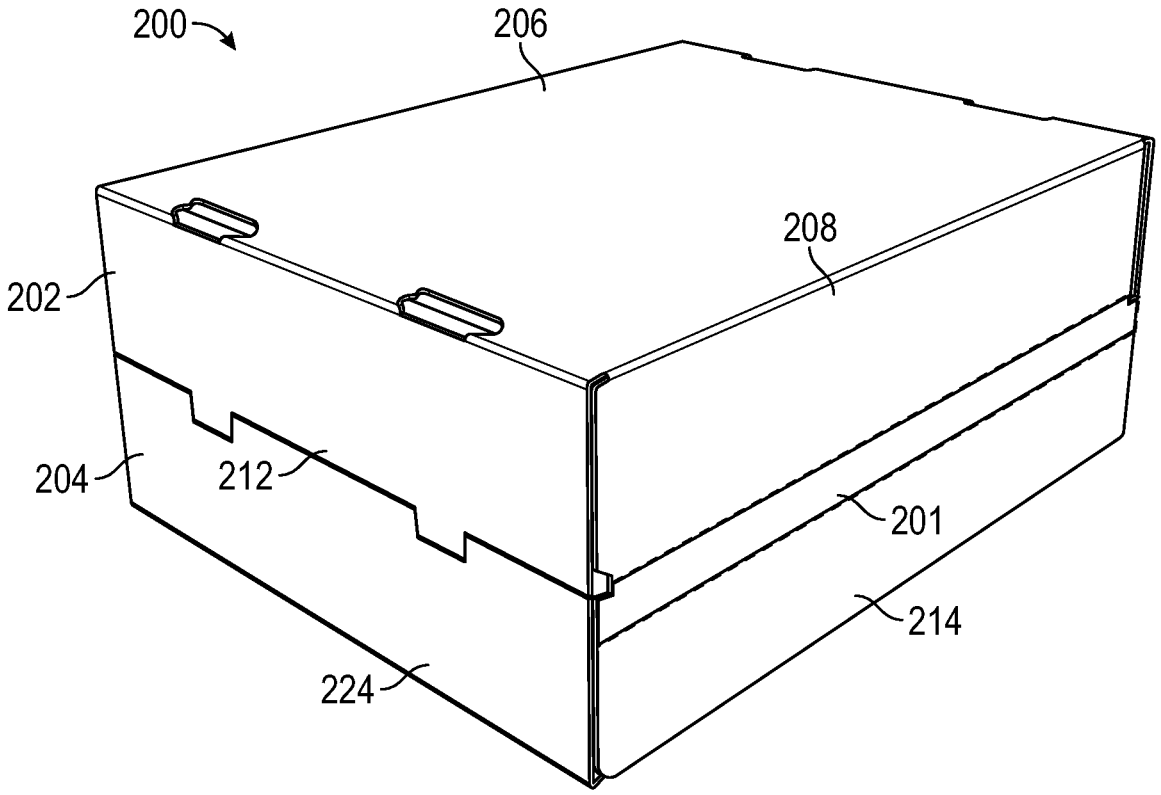
FIG. 13 is a perspective view of another exemplary container, showing the container assembled and in a closed and locked configuration.
Figure 14:
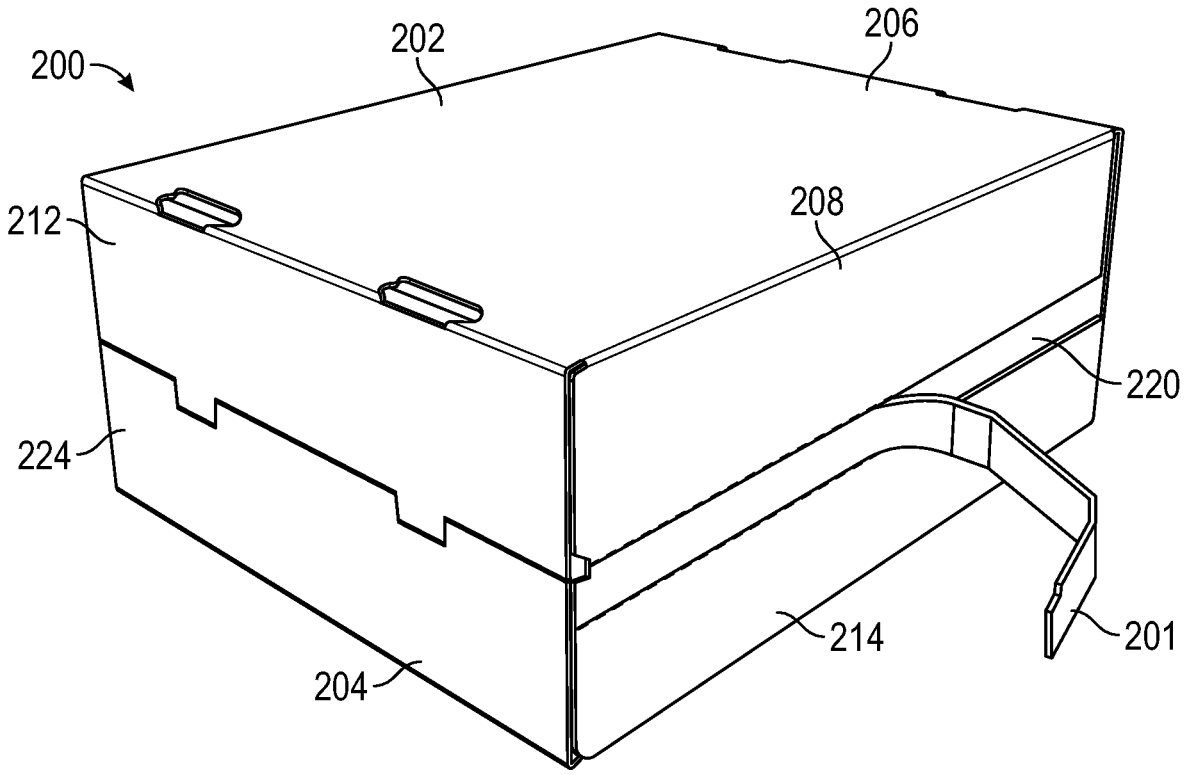
FIG. 14 is a perspective view of the container of FIG. 13, showing the container assembled and in a closed and partially unlocked configuration.
Figure 15:
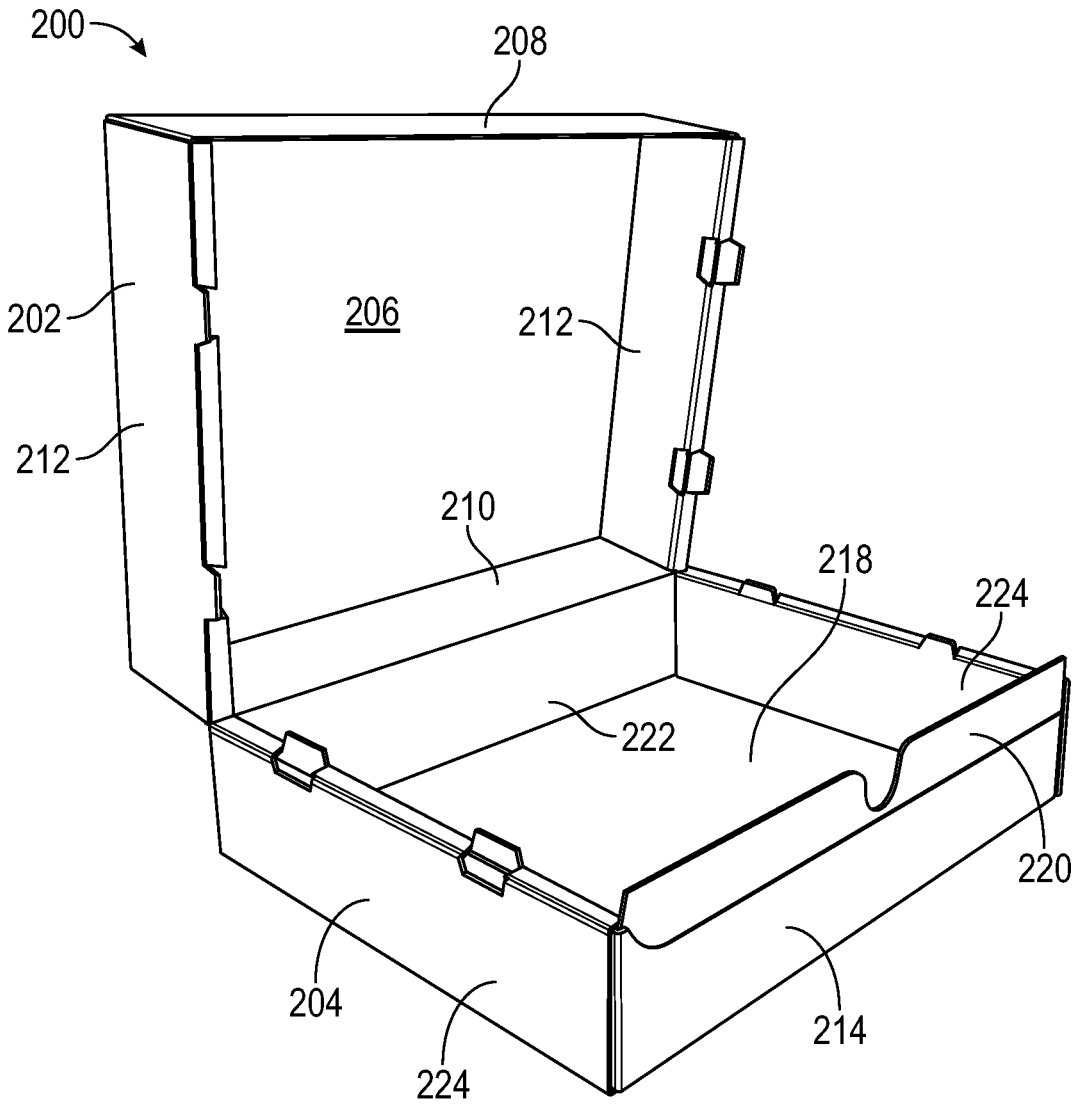
FIG. 15 is a perspective view of the container of FIG. 13, showing the container assembled and in an open configuration.
Figure 16:
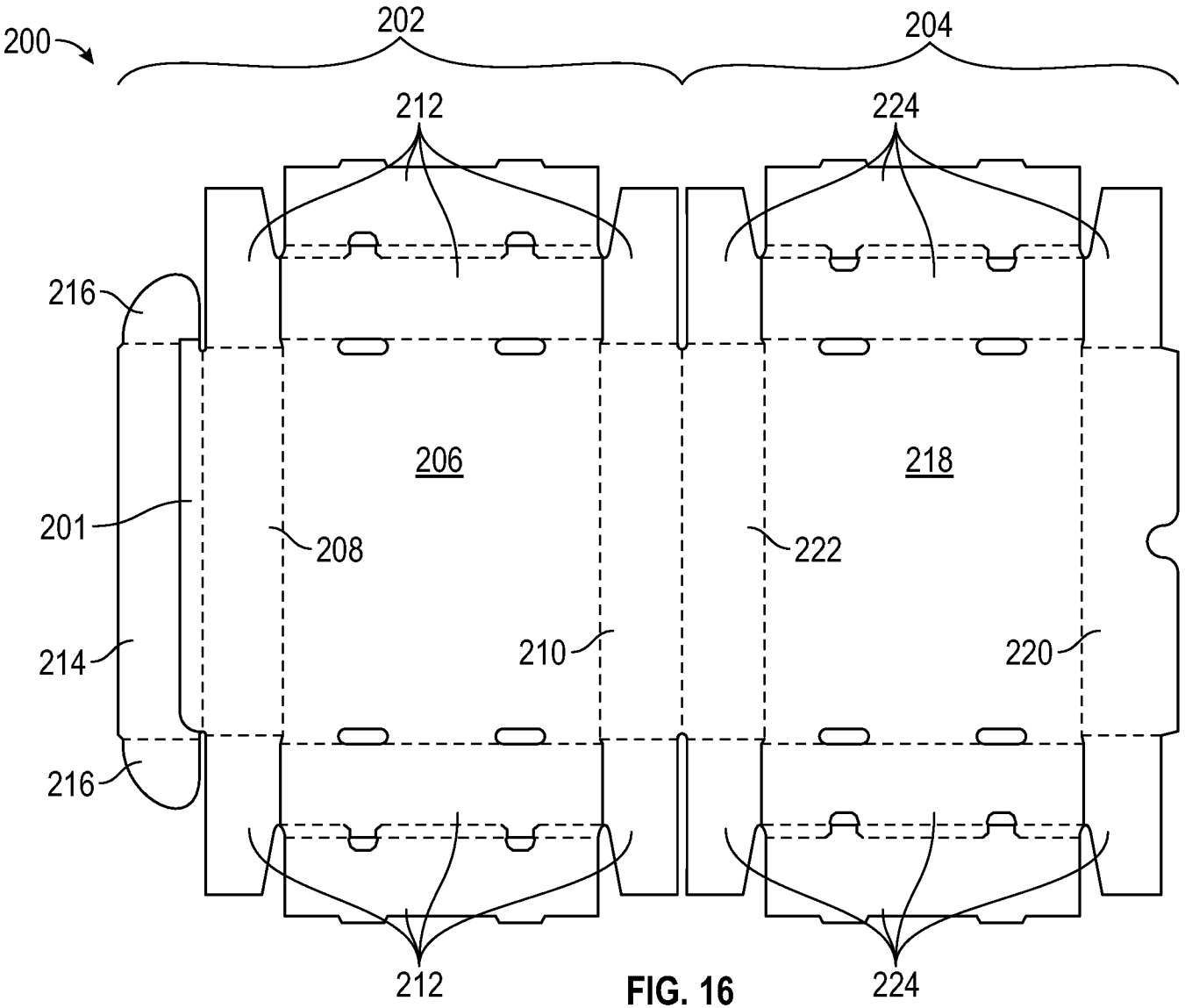
FIG. 16 is a plan view of the container of FIG. 13, showing the container in a blank configuration.

FIGS. 13-16 show a container 200, according to another embodiment. The container 200 is configured similar to the container 100, except the container 200 has a removable sealing member 201 (e.g., a tear strip). FIG. 13 shows the container 200 in an assembled and closed configuration with the sealing member 201 in an attached or sealed state. FIG. 14 shows the container 200 in the assembled and closed configuration with the sealing member 201 in a partially detached or partially unsealed state. FIG. 15 shows the container 200 in an assembled and open configuration, which can occur after the sealing member (not shown) is completely detached. A configuration in which the sealing member is completely detached (e.g., as shown in FIG. 15) can also be referred to as "an unsealed state." FIG. 16 shows the container 200 in a blank configuration.

The container 200 comprises a top portion 202 and a bottom portion 204 that are pivotably coupled together, as shown in FIG. 15. Referring to FIG. 16, the top portion 202 comprises a top panel 206, a front panel 208, a back panel 210, sidewalls 212, and a locking panel 214 with flaps 216. The sealing member 201 is initially part of the top portion 202 and is disposed between the front panel 208 and the locking panel 214. The bottom portion 204 comprises a bottom panel 218, a front panel 220, a back panel 222, and sidewalls 224. The top and bottom portions 202, 204 abut each other in the closed configuration, as shown in FIGS. 13-14. To help retain the top and bottom portions in the closed configuration, the portions can, in some instances, comprise mating features (e.g., tabs and/or slots) disposed on the abutment surfaces (e.g., on the sidewalls 212, 224), as shown in FIG. 15.

The container 200 can be assembled from the blank configuration (e.g., FIG. 16) to the assembled and closed configuration (e.g., FIG. 13) similar to the manner in which the container 100 is assembled (see, e.g., FIGS. 5-10). In some embodiments, the locking panel 214 of the top portion 202 can be secured to the front panel 220 of the bottom portion 202 to retain the container 200 in the closed configuration. This can be accomplished in various ways, including by adhesive, fasteners, tape, and/or other means for securing. This can prevent the flaps 216 of the locking panel 214 from being withdrawn from the bottom portion 204, thereby preventing the container 200 from being opened. In such embodiments, the sealing member 201 can be removed, which separates the locking panel 214 from the front panel 208 of the top portion 202, leaving the locking panel 214 attached to the front panel 220 of the bottom portion 204. This allows the top portion 202 to pivot relative to the bottom portion 204 and the container 200 to be opened.

The sealing member 201 can be a perforated tear strip as shown in the illustrated embodiment. In other embodiments, the sealing member 201 can comprise an embedded cable or string configured to tear through the material adjacent the sealing member 201. In either case, once the container 200 is sealed, a recipient can be notified whether the container 200 has been opened by observing whether the sealing member 201 is still intact. In this manner, the sealing member 201 can provide evidence of tampering.

Figure 17:
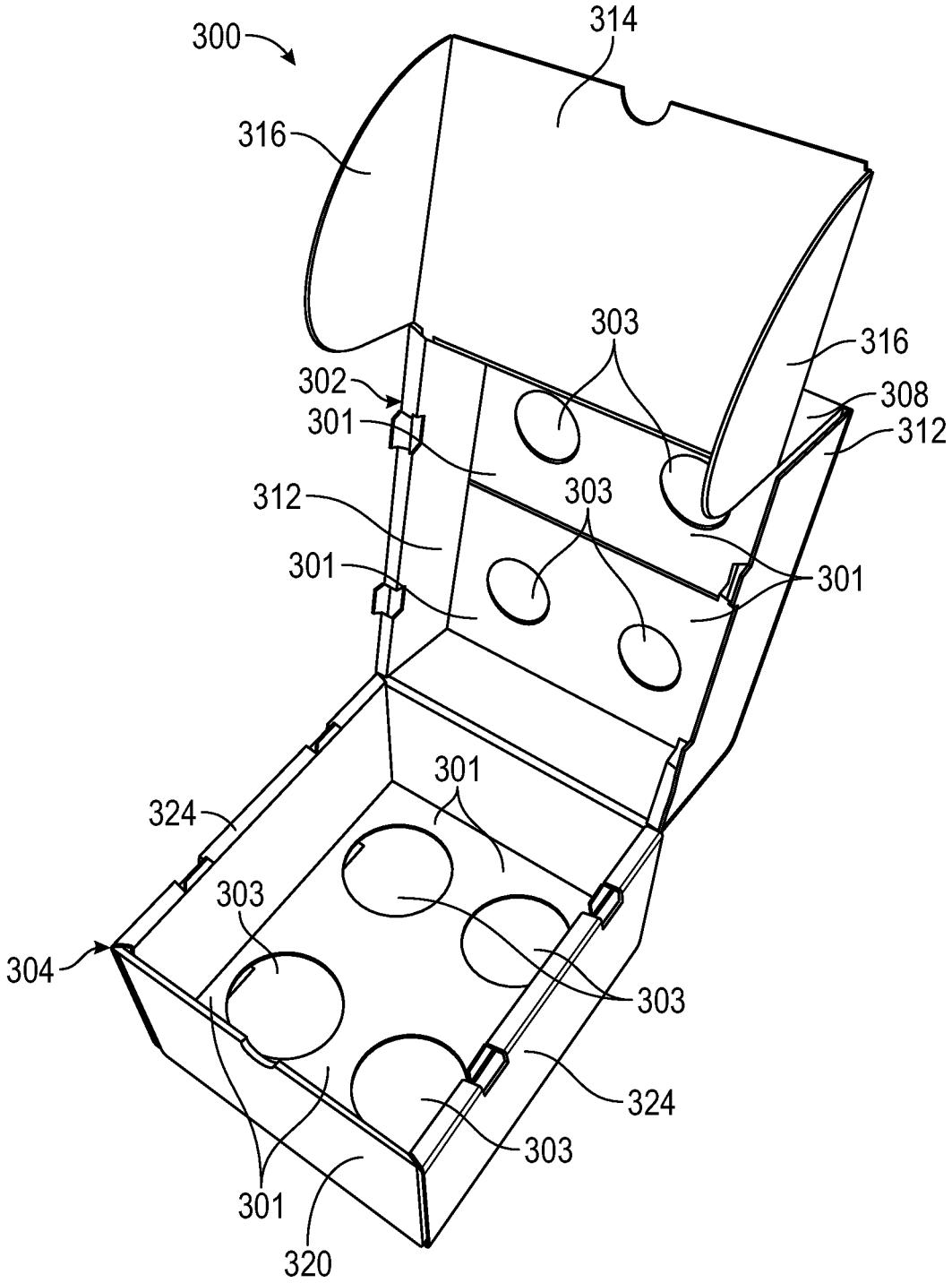
FIG. 17 is a perspective view of another exemplary container, showing the container assembled and in an open configuration.
Figure 18:
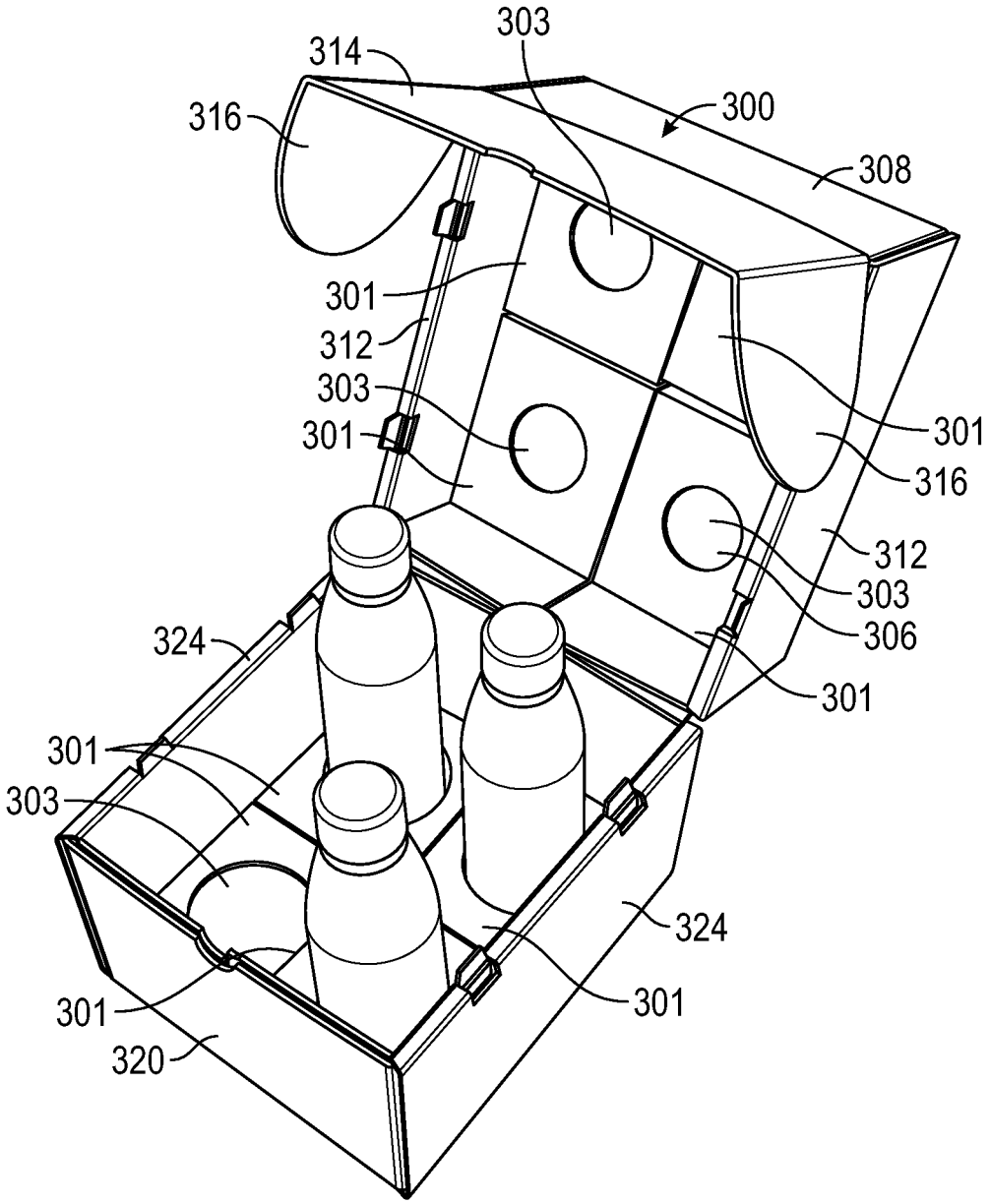
FIG. 18 is a perspective view of the container of FIG. 17, showing the container assembled and in the open configuration with exemplary objects disposed therein.
Figure 19:
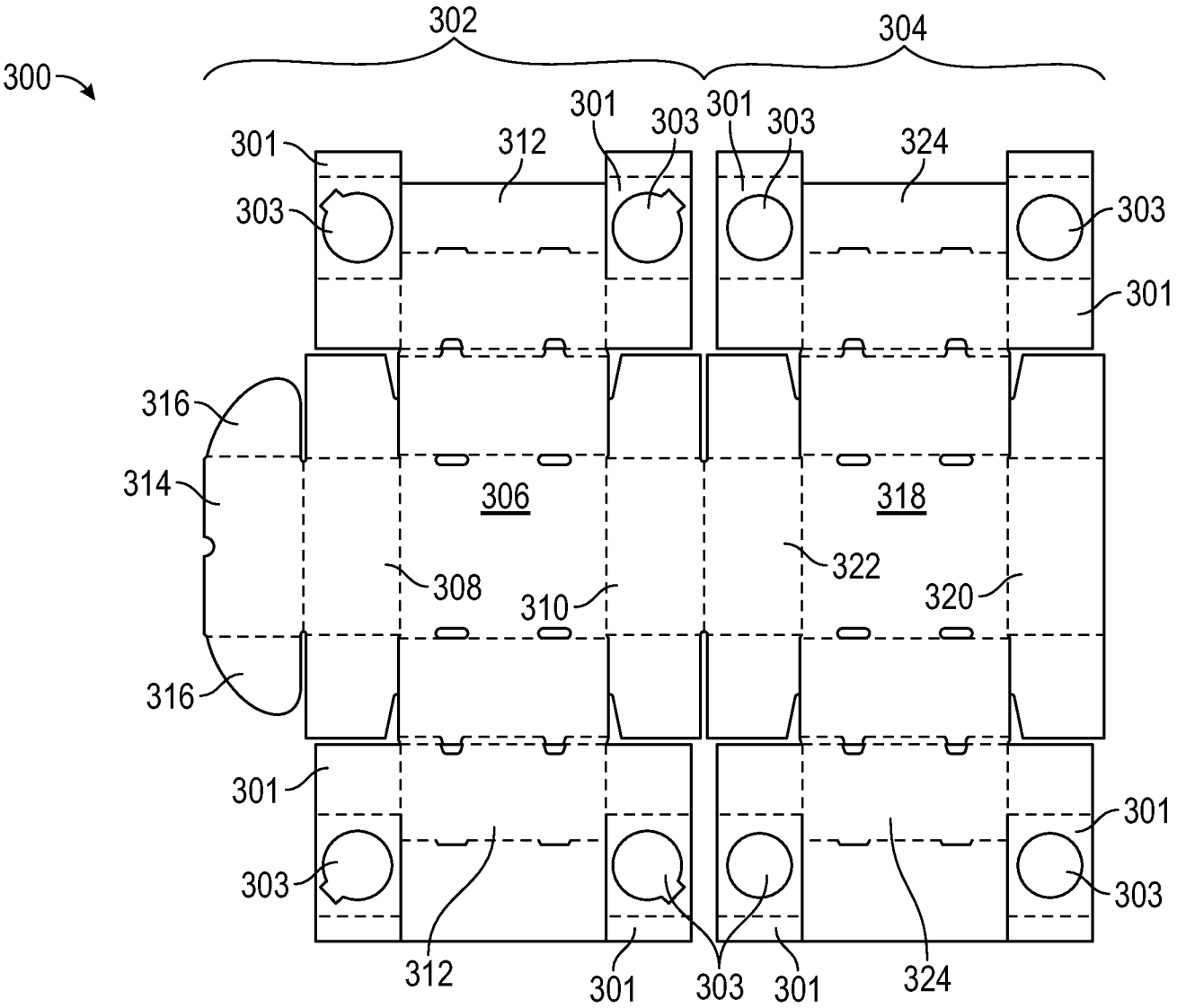
FIG. 19 is a plan view of the container of FIG. 17, showing the container in a blank configuration.

FIGS. 17-19 show a container 300, according to another embodiment. The container 300 is configured generally similar to the containers 100 and 200 in that the container 300 has a clamshell configuration with abutting surfaces. One difference between the container 300 and the containers 100 and 200 is that the container 300 has additional product retention panels 301 that are disposed within the interior chamber of the container 300 in the assembled configuration, as shown in FIG. 17. The product retention panels 301 can, for example, be used to secure objects within the container and/or to retain the objects in a desired orientation during transit and/or display (see, e.g., FIG. 19). The product retention panels can be particularly useful, for example, with fragile merchandise (e.g., glass bottles) and/or for objects that have shapes (e.g., circular, cylindrical, etc.) that tend to roll or shift in transit. The product retention panels 301 can also provide a pleasant unboxing experience by helping to ensure the objects are displayed in a desired orientation when the container 300 is opened.

FIG. 17 shows the container 300 in an assembled and open configuration without objects in the product retention panels 301. FIG. 18 shows the container 300 in the assembled and open configuration with exemplary objects (e.g. bottles) in the product retention panels 301. FIG. 19 shows the container 300 in a blank configuration.

The container 300 comprises a top portion 302 and a bottom portion 304 that are pivotably coupled together, as shown in FIG. 17. Referring to FIG. 19, the top portion 302 comprises a top panel 306, a front panel 308, a back panel 310, sidewalls 312, a locking panel 314 with flaps 316, and the product retention panels 301. The product retention panels 301 of the top portion 302 extend from the sidewalls 312. The bottom portion 304 can comprise a bottom panel 318, a front panel 320, a back panel 322, and sidewalls 324. The product retention panels 301 of the bottom portion extend from the sidewalls 324.

In the illustrated embodiment, the top portion 302 and the bottom portion 304 each have product retention panels 301. This configuration can be used, for example, to secure both the top and bottom of a product. In other embodiments, the top portion can have product retention panels and the bottom portion can omit product retention panels, or vice versa. This configuration can, for example, reduce the amount of material needed to form a container.

The product retention panels 301 comprise openings 303 configured for receiving a portion of the product. In some embodiments, the openings 303 of the top portion 302 can be smaller than the openings 303 of the bottom portion 304. In other embodiments, the openings 303 of the top portion 302 can be larger than the openings 303 of the bottom portion 304. In yet other embodiments, the openings 303 of the top portion 302 can be the same size as the openings 303 of the bottom portion 304. In some instances, the openings of one portion (e.g., the top portion) can be different sizes.

The openings 303 of the product retention panels 301 can comprise various shapes. For example, in the illustrated embodiment, the openings 303 are circular. In other embodiments, the openings can be ovular, square, rectangular, triangular, hexagonal, star-shaped, t-shaped, and/or various other shapes. In some instances, the openings 303 in the top portion 302 can comprise a first shape (e.g., circular), and the openings 303 of the bottom portion 304 can comprise a second shape (e.g., square). This configuration can be used, for example, with a product having a square base and round top, such as a decorative bottle. In some instances, a first opening 303 of the top portion 302 can comprise a first shape (e.g., ovular) and a second opening 303 of the top portion 302 can comprise a second shape (e.g., rectangular). This configuration can be used, for example, when different items are combined in the same container.

Figure 20:
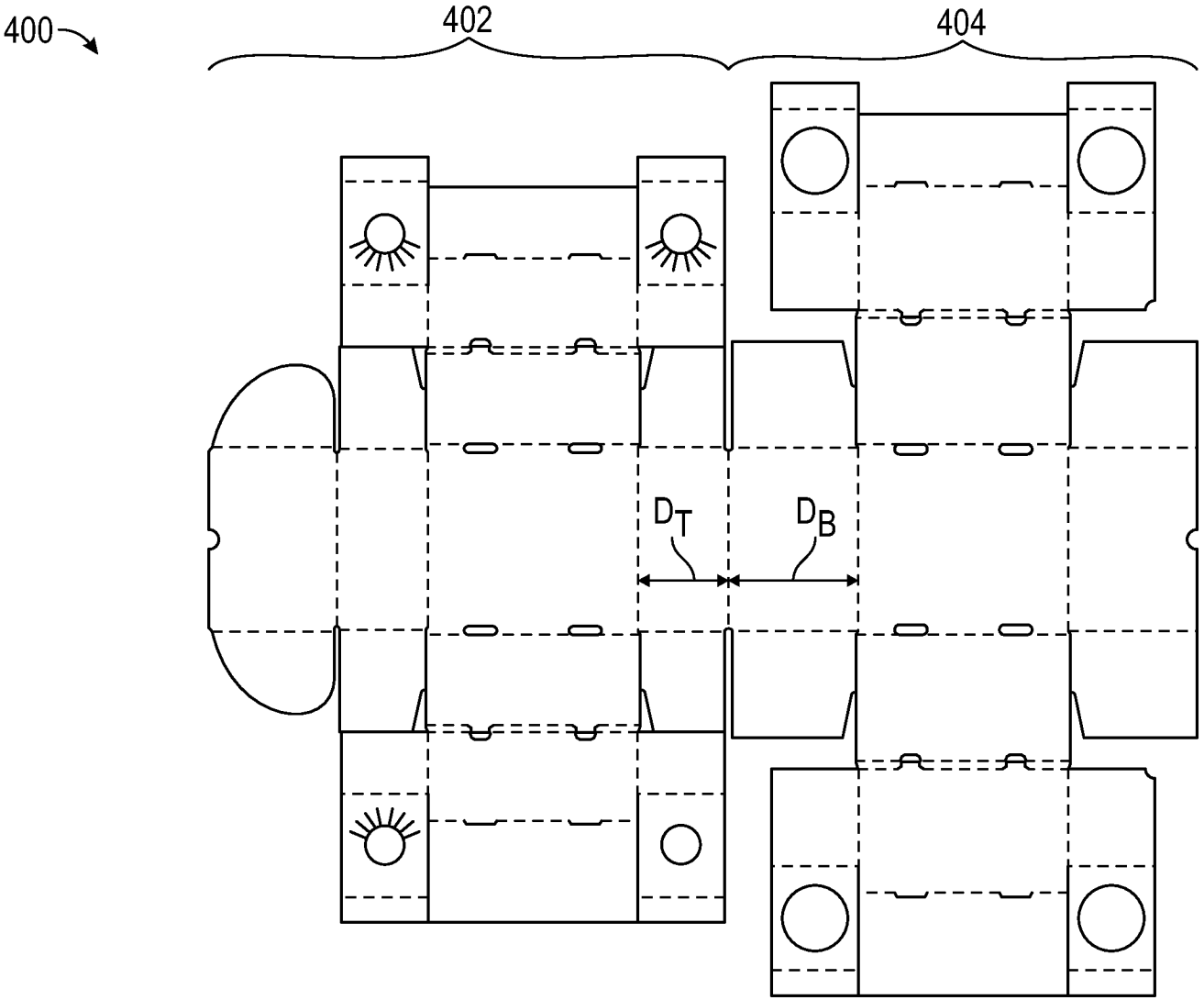
FIG. 20 is a plan view of another exemplary container, showing the container in a blank configuration.

FIG. 20 shows a container 400 in a blank configuration, according to yet another embodiment. The container 400 can, in some instances, be configured similar to the container 300. One difference between the container 400 and the container 300 is that a top portion 402 of the container 400 has a depth DT that is less than a depth DB of a bottom portion 404 of the container 400, whereas the container 300 has the same depth for the top portion 302 and the bottom portion 304. In other words, the interior chamber of the top portion 402 will be shallower than the interior chamber of the bottom portion 404 when the container 400 is assembled. In other embodiments, the container 400 can be configured such that the depth DT of the top portion 402 is greater than the depth DB of the bottom portion 404. In such configurations, the interior chamber of the top portion 402 will be deeper than the interior chamber of the bottom portion 404 when the container 400 is assembled.

Figure 21:
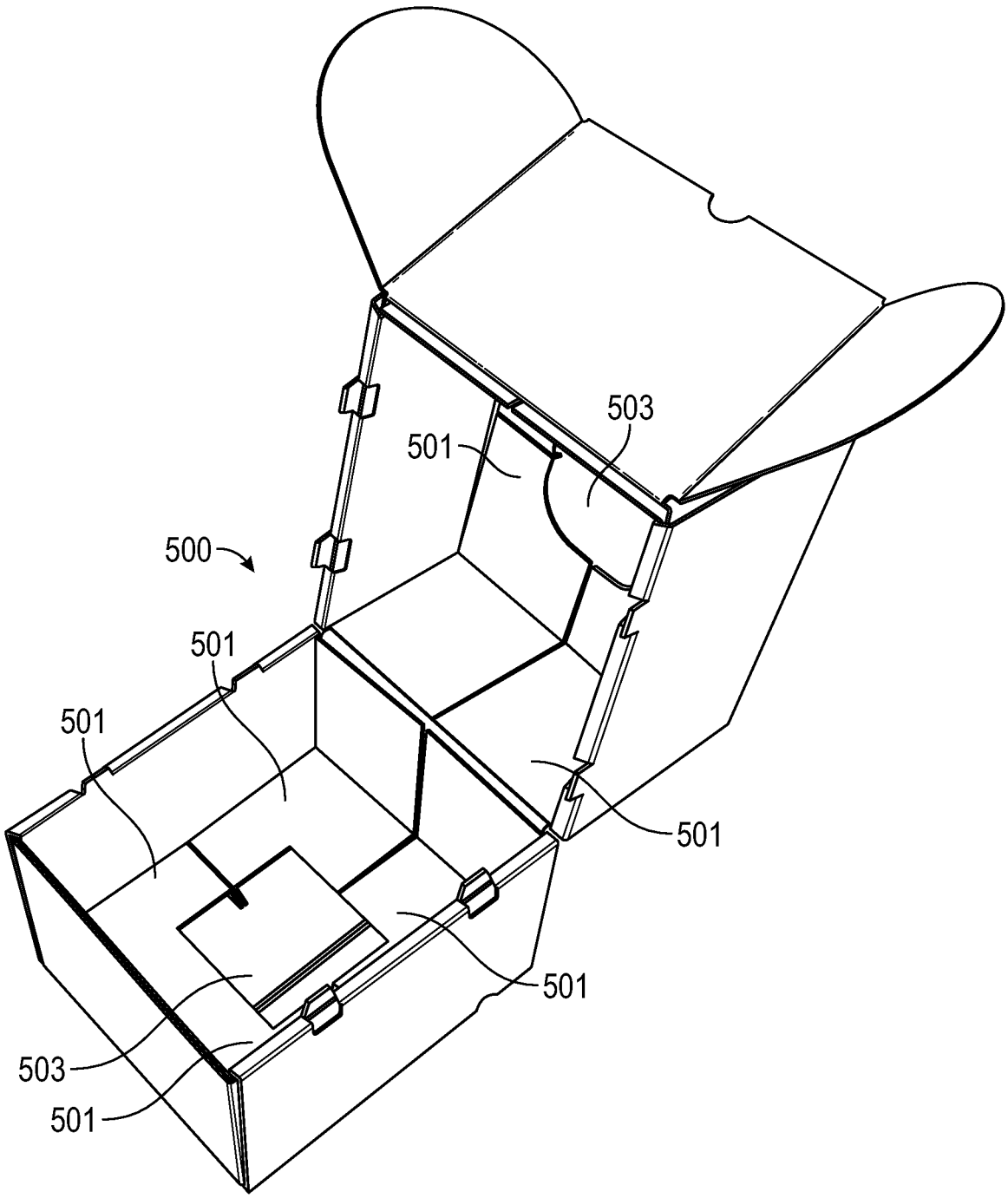
FIG. 21 is a perspective view of another exemplary container, showing the container assembled and in an open configuration.

FIG. 21 shows a container 500, according to yet another embodiment. The container 500 can, in some instances, be configured similar to the container 300. For example, the container 500 comprises product retention panels 501. The product retention panels 501 of the container 500 are different than the product retention panels 301 of the container 300. One difference is that the product retention panels 501 of the bottom portion collectively form an opening 503 configured for receiving an object, whereas each of the product retention panels 301 of the container 300 comprise individual openings 303.

In the illustrated embodiment, the opening 503 defined by the product retention panels 501 in the bottom portion of the container 500 comprises a square shape. This can be accomplished by configuring each product retention panel 501 with an L-shaped segment that is parallel to the bottom panel when the container 500 is assembled. In other embodiments, the opening can comprise various other shapes, such as circular, ovular, triangular, rectangular, etc. For example, a circular opening can be formed by configuring each product retention panel 501 with a C-shaped segment that is parallel to the bottom panel when the container 500 is assembled.

FIG. 21 also illustrates another feature of the containers disclosed herein. As shown, the disclosed containers can allow the container to be printed on only one side of the blank and yet have the printing show on the interior and exterior of the container when the container 500 is in the assembled configuration, as indicated by the "red" color shown in FIG. 21.

The containers described herein provide one or more advantages over typical clamshell containers. For example, certain embodiments of the disclosed containers can secure objects within the interior chamber, as well as provide easy access to the objects upon opening the container. Certain embodiments of the disclosed containers also provide a pleasant unboxing experience and/or uses less material than typical clamshell containers.

The features described herein with regard to any example can be combined with other features described in any one or more of the other examples, unless otherwise stated. For example, any one or more of the features of the container 100 can be combined with any one or more features of the container 300. As another example, any one or more features of the container 200 can be combined with any one or more features of the containers 400, 500, or vice versa.

Also, one or more features of a container may be omitted despite the feature being shown in an illustrated embodiment. For example, the containers 100, 200, 300, 400, and 500 are shown with mating features on the abutment surfaces, but in some embodiments, the containers 100, 200, 300, 400, and/or 500 can be formed without the mating features. As another example, in some instances, the container 200 can be formed without the flaps 216 of the locking panel 214 (e.g., when the locking panel 214 is secured to the front panel 220 of the bottom portion 204 with tape, adhesive, fasteners, etc.).

In view of the many possible embodiments to which the principles of the disclosure may be applied, it should be recognized that the illustrated embodiments are only preferred examples and should not be taken as limiting the scope of the claims. Rather, the scope of the claimed subject matter is defined by the following claims and their equivalents.

The invention claimed is:

1. A container comprising:

a first portion;

a second portion; and a locking panel, wherein the first and second portion are pivotably coupled together, wherein the first portion comprises first sidewalls, first tabs, and first slots, wherein the second portion comprises second sidewalls, second tabs, and second slots, wherein the first sidewalls of the first portion and the second sidewalls of the second portion abut when the container is in a closed configuration, wherein the first and second sidewalls comprise interlocking tabs and slots that mate with each other when the container is in the closed configuration, and wherein the first tabs of the first portion mate with the second slots of the second portion when the container is in the closed configuration, wherein the second tabs of the second portion mate with the first slots of the first portion when the container is in the closed configuration, and wherein the locking panel extends from the first portion and comprises a plurality of locking flaps, wherein the locking flaps extend into the second sidewalls of the second portion when the container is in the closed configuration, thereby retaining the container in the closed configuration.

2. The container of claim 1, wherein the container is formed from a single-piece blank.

3. The container of claim 1, wherein the first portion is a top portion, wherein the second portion is a bottom portion, and wherein the locking panel is a front portion of the top portion and the bottom portion when the container is in the closed configuration.

4. The container of claim 1, further comprising a sealing member coupled to the locking panel, wherein the locking panel can be secured to the second portion to retain the container in the closed configuration, and wherein the sealing member can be removed from the locking panel, thereby allowing the container to move from the closed configuration to an open configuration.

5. The container of claim 4, wherein the sealing member comprises a tear strip defined by a plurality of perforations.

6. The container of claim 4, wherein the sealing member comprises a cable or a string.

7. The container of claim 1, wherein the first portion comprises a top panel, a first front panel, a first back panel, the first sidewalls, and the locking panel, and wherein the second portion comprises a bottom panel, a second front panel, a second back panel, and the second sidewalls.

8. The container of claim 1, wherein the first sidewalls comprise an inner member, an outer member, and a plurality of intermediate members, wherein the intermediate members are disposed between the inner member and the outer member when the container is in an assembled configuration.

9. The container of claim 1, further comprising one or more product retention panels disposed in an interior chamber of the container and configured for engaging an exterior surface of an object disposed within the interior chamber of the container.

10. The container of claim 9, wherein the one or more product retention panels comprises an opening configured for receiving the object.

11. The container of claim 1, wherein the container comprises cardboard.

12. The container of claim 11, wherein the container comprises corrugated cardboard.

13. A box comprising:

a first portion comprising a top panel, a first front panel, a first back panel, a plurality of first sidewalls, and a locking panel comprising a plurality of flaps, wherein each of the first sidewalls comprises an inner member an outer member, and a plurality of intermediate members disposed between the inner member and the outer member when the box is in an assembled configuration, and wherein the top panel, the first front panel, the first back panel, and the inner members of the first sidewalls define a first interior chamber configured for receiving a first segment of an object; and a second portion comprising a bottom panel, a second front panel, a second back panel, and a plurality of second sidewalls, wherein each of the second sidewalls comprises an inner member an outer member, and a plurality of intermediate members disposed between the inner member and the outer member when the box is in the assembled configuration, and wherein the bottom panel, the second front panel, the second back panel, and the inner members of the second sidewalls define a second interior chamber configured for receiving a second segment of the object, wherein the first back panel of the first portion and the second back panel of the second portion are pivotably coupled together such that the first portion and the second portion can pivot relative to each other between a closed configuration and an open configuration, wherein in the closed configuration, the first sidewalls of the first portion abut the second sidewalls of the second portion, the first sidewalls and the second sidewall comprise mating features that contact, the locking panel extends from the first front panel of the first portion and over the second front panel of the second portion, and each flap of the locking panel extends between the inner member and the outer member of a respective second sidewall of the second portion; and wherein in the open configuration, the first sidewalls, the second sidewalls, and the mating features are spaced apart, and the flaps of the locking panel are withdrawn from the second sidewalls of the second portion.

14. The box of claim 13, wherein the mating features comprise tabs and slots.

15. The box of claim 13, further comprising a plurality of product retention panels coupled to the first portion or the second portion.

16. The box of claim 15, wherein the product retention panels are coupled to the first portion and the second portion.

17. The box of claim 15, wherein one of the product retention panels comprises an opening configured for receiving the object.

18. The box of claim 15, wherein each of the product retention panels comprises an opening configured for receiving the object.

19. The box of claim 15, wherein two or more of the product retention panels collectively form an opening configured for receiving the object.

20. A container comprising:

a first portion;

a second portion; and a locking panel, wherein the first and second portion are pivotably coupled together, wherein the first portion comprises a plurality of first sidewalls, each comprising an inner member, an outer member, and a plurality intermediate members disposed between the inner member and the outer member when the container is in an assembled configuration, wherein the second portion comprises a plurality of second sidewalls, wherein the first sidewalls of the first portion and the second sidewalls of the second portion abut when the container is in a closed configuration, wherein the first and second sidewalls comprise interlocking tabs and slots that mate with each other when the container is in the closed configuration, and wherein the locking panel extends from the first portion and comprises a plurality of locking flaps, wherein the locking flaps extend into the second sidewalls of the second portion when the container is in the closed configuration, thereby retaining the container in the closed configuration.

* * * * *